US012644375B2

(12) United States Patent
Ow et al.

(10) Patent No.: US 12,644,375 B2
(45) Date of Patent: Jun. 2, 2026

(54) QUANTIFYING ZONAL FLOW IN MULTI-LATERAL WELLS VIA TAGGANTS OF FLUIDS

(71) Applicant: Saudi Arabian Oil Company, Dhahran (SA)

(72) Inventors: Hooisweng Ow, Cambridge, MA (US); Sehoon Chang, Cambridge, MA (US); Gawain Thomas, Cambridge, MA (US); Wei Wang, Cambridge, MA (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/342,417

(22) Filed: Jun. 27, 2023

(65) Prior Publication Data

US 2025/0003331 A1 Jan. 2, 2025

(51) Int. Cl.
*E21B 47/11* (2012.01)
*E21B 34/06* (2006.01)

(52) U.S. Cl.
CPC ..... *E21B 47/11* (2020.05); *E21B 34/06* (2013.01)

(58) Field of Classification Search
CPC ..... E21B 47/11; E21B 47/111; E21B 34/06; E21B 41/0064; E21B 47/10
USPC ..... 166/250.12, 250.01, 252.6
See application file for complete search history.

(56) References Cited

U.S. PATENT DOCUMENTS 3,623,842 A 11/1971 Deans
4,558,219 A 12/1985 LeBlanc et al.
5,608,214 A * 3/1997 Baron ..... G01V 5/12 250/269.3

(Continued)

FOREIGN PATENT DOCUMENTS

CN 111764881 10/2020
GB 2528716 2/2016

(Continued)

OTHER PUBLICATIONS

SLB, Downhole Interval Control Valves, retrieved Mar. 29, 2024 from https://www.slb.com/products-and-services/innovating-in-oil-and-gas/completions/well-completions/intelligent-completions/downhole-interval-control-valves#:~:text=Interval%20or%20flow%20control%20valves,interventions%2C%20and%20maximize%20 (Year: 2024).*

(Continued)

*Primary Examiner* — Angela M DiTrani Leff
(74) *Attorney, Agent, or Firm* — Dinsmore & Shohl LLP

(57) ABSTRACT

A system and method for quantifying zonal flow in a multi-lateral well, including providing a first taggant through a first dosing tubing to a first lateral in a wellbore of the multi-lateral well, providing a second taggant through a second dosing tubing to a second lateral in the wellbore, flowing a first produced fluid from a subterranean formation via the first lateral into production tubing, flowing a second produced fluid including from the subterranean formation via the second lateral into the production tubing, flowing a produced stream including the first produced fluid and the second produced fluid uphole through the production tubing and discharging the produced stream from the wellbore, and analyzing the produced stream to measure an amount of the first taggant in the produced stream and an amount of the (Continued)

second taggant in the produced stream, wherein the first taggant and the second taggant are water soluble.

20 Claims, 16 Drawing Sheets

(56) References Cited

U.S. PATENT DOCUMENTS

| | | | | |
|---|---|---|---|---|
| 8,949,029 | B2 | 2/2015 | Nyhavn | |
| 9,133,683 | B2 | 9/2015 | Dyer et al. | |
| 9,284,833 | B2 | 3/2016 | Hewitt et al. | |
| 9,290,689 | B2 * | 3/2016 | Lafitte | E21B 47/11 |
| 9,910,026 | B2 | 3/2018 | Zhang et al. | |
| 10,815,775 | B2 * | 10/2020 | Lauritzen | E21B 27/02 |
| 10,871,067 | B2 | 12/2020 | Nyhavn | |
| 11,773,715 | B2 | 10/2023 | Poitzsch et al. | |
| 2007/0241277 | A1 * | 10/2007 | Stray | E21B 47/11 250/303 |
| 2007/0289740 | A1 * | 12/2007 | Thigpen | E21B 43/12 166/250.01 |
| 2011/0239754 | A1 | 10/2011 | Dyer et al. | |
| 2011/0240287 | A1 * | 10/2011 | Hartshorne | E21B 47/11 166/250.12 |
| 2011/0257887 | A1 * | 10/2011 | Cooper | E21B 47/11 702/12 |
| 2014/0299756 | A1 * | 10/2014 | Cameron | E21B 47/11 250/259 |
| 2015/0130468 | A1 * | 5/2015 | Christian | E21B 47/11 324/324 |
| 2015/0192008 | A1 | 7/2015 | Dikshit et al. | |
| 2016/0010454 | A1 | 1/2016 | Sira et al. | |
| 2017/0097443 | A1 | 4/2017 | Bernstein et al. | |
| 2018/0275114 | A1 | 9/2018 | Kosynkin et al. | |
| 2018/0282605 | A1 * | 10/2018 | Borrell | C09K 8/58 |
| 2018/0298274 | A1 * | 10/2018 | Zhao | C09K 8/588 |
| 2019/0382652 | A1 * | 12/2019 | Brierley | C09K 8/70 |
| 2020/0032641 | A1 | 1/2020 | Kulyakhtin et al. | |
| 2021/0332695 | A1 | 10/2021 | Shaw | |
| 2022/0056329 | A1 | 2/2022 | AlJabri et al. | |
| 2022/0065101 | A1 | 3/2022 | Poitzsch et al. | |
| 2022/0162927 | A1 * | 5/2022 | Rowaihy | E21B 33/124 |
| 2023/0193755 | A1 * | 6/2023 | Chen | E21B 43/12 166/250.12 |

FOREIGN PATENT DOCUMENTS

| | | |
|---|---|---|
| GB | 2569868 | 7/2019 |
| NO | 20140495 | 6/2014 |
| WO | WO 2012057634 | 5/2012 |
| WO | WO 2014104914 | 7/2014 |
| WO | WO 2016105210 | 6/2016 |
| WO | WO 2019066811 | 4/2019 |
| WO | WO 2020239649 | 12/2020 |

OTHER PUBLICATIONS

Merriam-Webster, region, retrieved Jul. 12, 2024 from https://www.merriam-webster.com/dictionary/region (Year: 2024).*

Aggrey et al., "A Novel Approach of Detecting Water Influx Time in Multi-Zone and Multilateral Completions Using Real-Time Downhole Pressure Data," Presented at the SPE Middle East Oil and Gas Show and Conference, Manama, Bahrain, Mar. 11-14, 2007, 11 pages.

Andresen et al., "Interventionless Surveillance in a Multi-Lateral Horizontal Well," Presented at the IADC/SPE Drilling Conference and Exhibition, San Diego, California, Mar. 6-8, 2012, 9 pages.

Anopov et al., "Permanent Downhole Chemical Tracer System for Wireless Surveillance and Optimizing Well Production," Presented at the SPE/IADC Middle East Drilling Technology Conference and Exhibition, Abu Dhabi, UAE, Jan. 31, 2018, 13 pages.

Chen et al., "Optimization of Tracer Injection Schemes for Improved History Matching," SPE-206142-MS, OnePetro, Sep. 2021, 9 pages.

Chen et al., "Upconversion Nanoparticles: Design, Nanochemistry, and Applications in Theranostics," Chemical Reviews, Mar. 2014, 114(10):5161-5214, 101 pages.

Dyer et al., "Technology Update: New Intelligent Completion System Enables Compartment-Level Control in Multilateral Wells," Journal of Petroleum Technology, Sep. 2016, 68(09):18-21, 3 pages.

Dyrli et al., "Ten Years of Reservoir Monitoring with Chemical Inflow Tracers—What Have We Learnt and Applied Over the Past Decade?" presented at the SPE Kuwait Oil & Gas Show and Conference, Kuwait City, Kuwait, Oct. 17, 2017, 22 pages.

Hu, "Utilizing Oil-soluble Tracers to Evaluate the Production Profile in Multistage Fractured Horizontal Wells," Thesis for the Degree of Master of Applied Science in Petroleum Systems Engineering, University of Regina, Dec. 2019, 186 pages.

Isoppo et al., "Highly Fluorescent Lipophilic 2,1,3-Benzothiadiazole Fluorophores as Optical Sensors for Tagging Material and Gasoline Adulteration with Ethanol," Sensors and Actuators B: Chemical, Apr. 2020, 35 pages.

Jose et al., "Benzophenoxazine-Based Fluorescent Dyes for Labeling Biomolecules," Tetrahedron, Nov. 2006, 62:(48):11021-11037, 17 pages.

Joubran, "Intelligent Completions: Design and Reliability of Interval Control Valves in the Past, Present, and Future," Presented at the Offshore Technology Conference, Houston, Texas, May 3, 2018, 29 pages.

Li et al., "Evaluation of the Release Mechanism of Sustained-Release Tracers and its Application in Horizontal Well Inflow Profile Monitoring," ACS Omega, Jul. 19, 2021, 6(29):19269-19280, 12 pages.

Muradov et al., "Zonal Rate Allocation in Intelligent Wells," Presented at the EUROPEC/EAGE Conference and Exhibition, Amsterdam, The Netherlands, Jun. 8-11, 2009, 13 pages.

Oftedal et al., "Permanent Chemical Tracers Piloted for Inflow Monitoring in Cemented Production Liner," Prepared for presentation at the Offshore Technology Conference held in Houston, Texas, May 2-5, 2016.

Ow et al, "First Deployment of a Novel Advanced Tracers System for Improved Waterflood Recovery Optimization," SPE-192598, Society of Petroleum Engineers, Nov. 2018, 10 pages.

Ow et al., "Automatable High Sensitivity Tracer Detection: Toward Tracer Data Enriched Production Management of Hydrocarbon Reservoirs," Presented at the SPE Annual Technical Conference and Exhibition, Dubai, UAE, Sep. 22, 2021, 10 pages.

pubchem.ncbi.nlm.nih.gov [online], "2-(2-Ethylhexyl)-6,7-dimethoxy-1H-benz[de]isoquinoline-1,3(2H)-dione," Aug. 8, 2005, via Internet Archive: Wayback Machine URL <https://web.archive.org/web/20240306211042/https://pubchem.ncbi.nlm.nih.gov/compound/92025#section=2D-Structure>, retrieved on Mar. 6, 2024, 12 pages.

pubchem.ncbi.nlm.nih.gov [online], "Bis(2-methylpropyl) 4,10-dicyanoperylene-3,9-dicarboxylate," Feb. 8, 2007, via Internet Archive: Wayback Machine URL <https://web.archive.org/web/20240306210457/https://pubchem.ncbi.nlm.nih.gov/compound/13750327>, retrieved on Mar. 6, 2024, 15 pages.

pubchem.ncbi.nlm.nih.gov [online], "Perylene Red," Jul. 4, 2007, via Internet Archive: Wayback Machine URL <https://web.archive.org/web/20240306211744/https://pubchem.ncbi.nlm.nih.gov/compound/16172388#section=Deprecated-CAS>, retrieved on Mar. 6, 2024, 16 pages.

Salimov et al., "Allocation of Zonal Production in Smart Wells: Offshore Abu-Dhabi Case Study," presented at the Abu Dhabi International Petroleum Exhibition & Conference, Abu Dhabi, UAE, Nov. 16, 2017, 11 pages.

Thomas et al., "Deployment and Detection of a Novel Barcoded Advanced Tracers System for the Optimization of Improved Waterflood Recovery in Hydrocarbon Reservoirs," Presented at the SPE Middle East Oil and Gas Show and Conference, Manama, Bahrain, Mar. 20, 2019, 10 pages.

Williams et al., "Wireless Reservoir Surveillance Using Intelligent Tracers," Presented at the Offshore Technology Conference, Houston, Texas, Apr. 30-May 3, 2012, 11 pages.

(56) References Cited

OTHER PUBLICATIONS

Zhou et al., "Upconversion Luminescent Materials: Advances and Applications," Chemical Reviews, Dec. 2014, 115(1):395-465, 71 pages.

* cited by examiner

200

300

302

304

306

308

310

312

500

QUANTIFYING ZONAL FLOW IN MULTI-LATERAL WELLS VIA TAGGANTS OF FLUIDS

TECHNICAL FIELD

This disclosure relates to reservoir management involving quantifying zonal flow in multi-lateral wells.

BACKGROUND

A wellbore in a subterranean formation in the Earth crust may be treated. The wellbore treatments may be to facilitate production of hydrocarbon, such as crude oil or natural gas, from the subterranean formation. The wellbore treatments may be to collect data and understand the production.

Hydrocarbon reservoir management may be accomplished by increasing or optimizing the recovery of oil and gas while reducing the capital investments and operating expenses. Flow model predictions may be combined with price forecasts to estimate how much revenue will be generated by a proposed reservoir management plan. Revenue stream forecasts may be used to prepared both short and long term budgets. The reservoir management process can be characterized as integrated, dynamic, and ongoing. The process is integrated because various technical, economic, and other factors may play roles in managing a reservoir, which can work in an integrated manner. For instance, the management may decide when to initiate an enhanced oil recovery (EOR) process on basis of market conditions.

Crude oil development and production in oil reservoirs may be separated into at least the three phases of primary, secondary, and tertiary. Primary recovery (for example, via pressure depletion) and secondary oil recovery (for example, via water injection) in combination generally recover about 20% to 50% of original oil in place (OOIP). Therefore, a large amount of oil (for example, at least 50% of the crude oil in the reservoir) typically remains in the reservoir or geological formation after these conventional oil-recovery processes of primary recovery and secondary recovery. Primary and secondary recovery of production can leave up to 75% of the crude oil in the well. Primary oil recovery is generally limited to hydrocarbons that naturally rise to the surface or recovered via artificial lift devices such as pumps. Secondary recovery employs water and gas injection to displace oil to the surface.

A way to further increase oil production is through tertiary recovery also known as EOR. FOR or tertiary oil recovery increases the amount of crude oil or natural gas that can be extracted from a reservoir or geological formation. Although typically more expensive to employ on a field than conventional recovery, FOR can increase production from a well up to 75% recovery or more. FOR or tertiary recovery can extract crude oil from an oil field that cannot be extracted otherwise. There are different FOR or tertiary techniques.

An understanding of the hydrocarbon flow dynamics, flow paths, and produced/available amounts of hydrocarbon in a given reservoir can aid in reservoir management.

SUMMARY

An aspect relates to a method of quantifying zonal flow in a multi-lateral well, including providing a first taggant through a first dosing tubing to a first lateral in a wellbore of the multi-lateral well; providing a second taggant through a second dosing tubing to a second lateral in the wellbore; flowing a first produced fluid including hydrocarbon and water from a subterranean formation via the first lateral through a first valve into production tubing in the wellbore; flowing a second produced fluid including hydrocarbon and water from the subterranean formation via the second lateral through a second valve into the production tubing; flowing a produced stream including the first produced fluid and the second produced fluid uphole through the production tubing and discharging the produced stream from the wellbore; and analyzing the produced stream to measure an amount of the first taggant in the produced stream and an amount of the second taggant in the produced stream, wherein the first taggant and the second taggant are water soluble.

Another aspect relates to a method of quantifying zonal flow in a multi-lateral well, including providing a first tracer through a first dosing tubing to a first region of a wellbore of the multi-lateral well, the first region associated with a first lateral of the wellbore; providing a second tracer through a second dosing tubing to a second region of the wellbore, the second region associated with a second lateral of the wellbore, wherein the first tracer comprises a first sulfonate and the second tracer comprises a second sulfonate; flowing from a subterranean formation a first produced fluid comprising hydrocarbon and water through the first lateral and a first valve into production tubing in the wellbore; flowing from the subterranean formation a second produced fluid comprising hydrocarbon and water through the second lateral and a second valve into the production tubing; flowing a produced stream comprising the first produced fluid and the second produced fluid uphole through the production tubing and discharging the produced stream from the wellbore; and analyzing the produced stream to measure an amount of the first tracer in the produced stream and an amount of the second tracer in the produced stream.

Yet another aspect relates to a method of quantifying zonal flow in a multi-lateral well, including: providing a first taggant from Earth surface through a first dosing tubing to a first region in a wellbore of the multi-lateral well, wherein the wellbore is formed through the Earth surface into a subterranean formation in Earth crust, wherein the first region is a region of intersection of a first lateral in the wellbore with a vertical portion of the wellbore; providing a second taggant from the Earth surface through a second dosing tubing to a second region in the wellbore, wherein the second region is a region of intersection of a second lateral in the wellbore with the vertical portion; producing a first produced fluid from the subterranean formation through the first lateral into production tubing in the wellbore; producing a second produced fluid from the subterranean formation through the second lateral into the production tubing; flowing a produced stream comprising the first produced fluid and the second produced fluid uphole through the production tubing and discharging the produced stream from the wellbore; and analyzing the produced stream to measure an amount of the first taggant in the produced stream and an amount of the second taggant in the produced stream, wherein the first taggant and the second taggant each comprise at least one of Disodium 1,5-naphthalenedisulfonate hydrate (1,5-NDS), Disodium 2,7-naphthalenedisulfonate (2,7-NDS), Sodium 2-naphthalenesulfonate (2-NS), Sodium 4-amino-1-naphthalenesulfonate tetrahydrate (ANS), 8-Aminonaphthalene-1,3,6-trisulfonic acid, disodium salt (ANTS), Pyranine, or 1,3,6,8-Pyrenetetrasulfonic acid (PTSA).

The details of one or more implementations are set forth in the accompanying drawings and the description below.

Other features and advantages will be apparent from the description and drawings, and from the claims.

DETAILED DESCRIPTION

Figure 1:
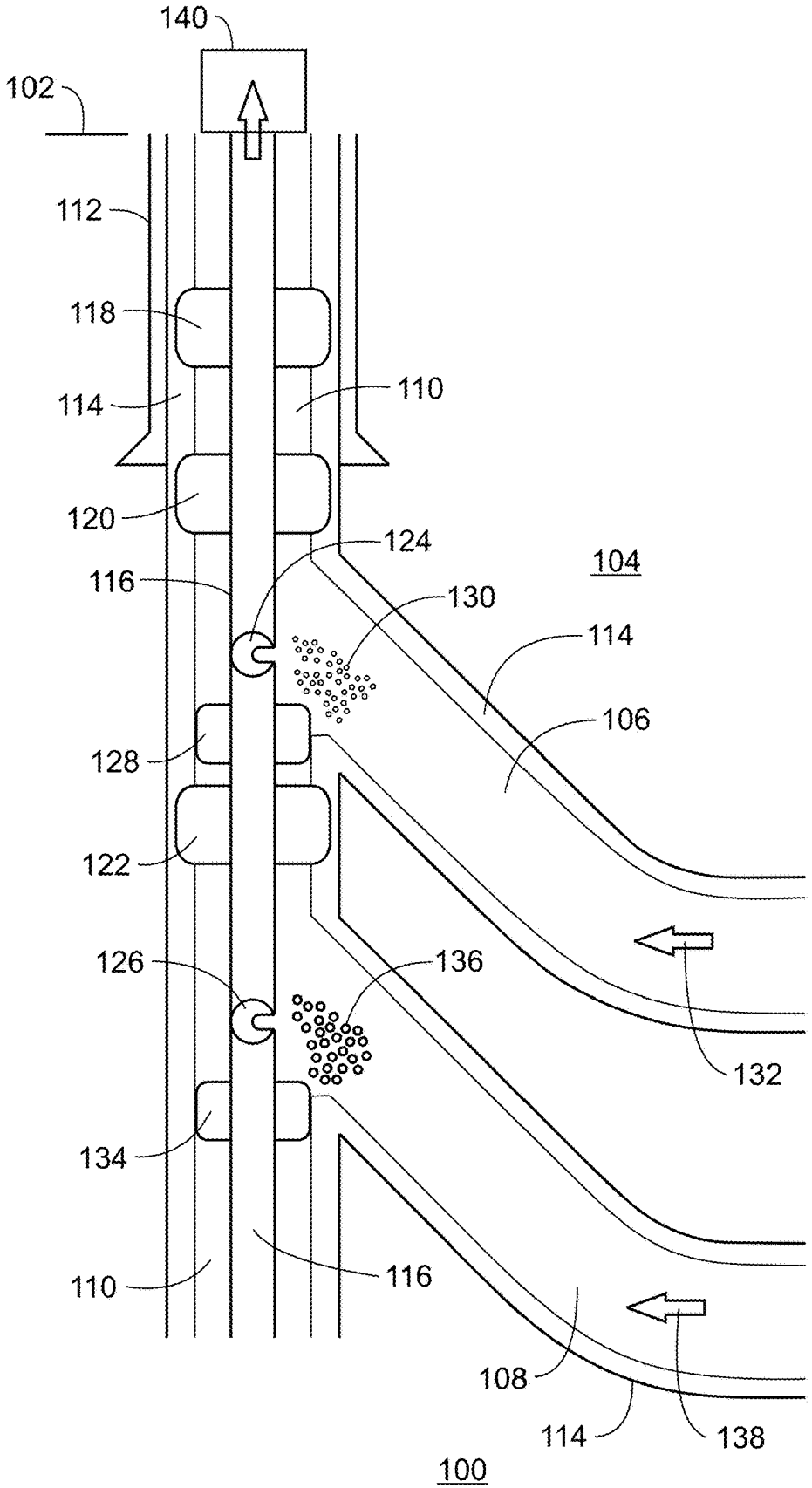
FIG. 1 is a diagram of a wellbore formed through the Earth surface into a subterranean formation in the Earth crust.

Some aspects of the present disclosure are directed to water-soluble tracers for quantifying zonal flow in multilateral wells. The tracers can be labeled as taggants of fluids. Dosing tubing (e.g., capillary dosing lines) is utilized to inject the tracers from the wellhead at surface into the different downhole zones (laterals). An abrupt tracer dosing shut off generates a transient in tracer concentrations as the production flows carrying the tracers to the surface, obviating the need to shut in the well.

The carrier fluid of the tracers (taggants) as injected may be injection water (seawater, tap water, deionized water, etc.) or a polar solvent, such as ethylene glycol.

At surface, chromatographic and spectrometric techniques for the separation/detection of the tracers from dissolved organic matter interferents are employed. An interferent may be any material or condition that can affect the true measurement or detection of the tracers.

The tracer (taggant) concentrations dosed into the laterals and collected with the produced fluids at the surface over a prescribed time duration are utilized to quantitate (quantify) the contributions of fluids from each lateral. The tracers may be selectively soluble taggants of fluids for quantification of zonal flow in multi-lateral wells (multi-lateral wellbores). The tracers may be selectively soluble, for example, for aqueous phases or water.

In embodiments herein, the tracers are generally highly water-soluble naphthalene sulfonate (e.g., 1,5-NDS, ANS, 2,7-NDS, and 2-NS) and pyrene sulfonate derivatives (e.g., pyranine and PTSA), and moderately water-soluble anthracene sulfonates (e.g., ANTS). In particular, the water-soluble tracers may include, for example, at least one of the following seven tracers: Disodium 1,5-naphthalenedisulfonate hydrate (1,5-NDS), Disodium 2,7-naphthalenedisulfonate (2,7-NDS), Sodium 2-naphthalenesulfonate (2-NS), Sodium 4-amino-1-naphthalenesulfonate tetrahydrate (ANS), 8-Aminonaphthalene-1,3,6-trisulfonic acid disodium salt (ANTS) (also called disodium 8-amino-1,3,6-naphthalenetrisulfonate), Pyranine, and 1,3,6,8-Pyrenetetrasulfonic acid (PTSA) ($C_{16}H_{10}O_{12}S_4$) (also called 1,3,6,8-Pyrene tetrasulfonate).

The complexities of well completions have increased steadily over the years with the rapid advancement in extended reach drilling technology. Wells are routinely completed in multilayered reservoirs, with multilaterals that have compartments with varying pressure. Intelligent completions that include valves and sensors can contribute to efficient reservoir management practice to monitor production and execute appropriate and beneficial well intervention. The valves may include, for example, flow control valves (FCVs). The sensors may include sensors or gauges [e.g., permanent downhole gauges (PDGs)] and may measure, for example, that measure water cut (e.g., volume percent water) and fluid flow rate (e.g., mass per time or volume per time) including in real time. In such intelligent completions, electrically controllable FCVs can be remotely adjusted in real-time to increase, balance, or optimize production after oil and water rate feedbacks from downhole PDGs in the field for relatively large areas of a reservoir, increasing or maximizing hydrocarbon recovery with shorter optimization cycle due to more informed reservoir management decisions.

In one example, the Manara production and reservoir management system, which was launched as a collaboration between Saudi Arabian Oil Company (having headquarters in Dhahran, Saudi Arabia) and Schlumberger Limited (SLB) (having headquarters in Houston, Texas, USA), provides for simultaneous, real-time monitoring and control utilizing a single electric control line of up to 60 compartments in multilateral wells, with extended-reach sections longer than 12 kilometers (km). Nonetheless, even with the commercialization of the Manara platform in September 2015, pervasive adoption of the technologies that enable or facilitate compartment-level control have been stymied by costs and long-term device reliability in high salinity and pressure downhole conditions.

For multilateral wells, the installation of interval control valves (ICVs) that can have adequate controls (e.g., simplified controls), run history (e.g., long-term run history), and reliability may be a beneficial intermediate step toward the vision of full-field deployment of entirely automatable intelligent completions with real-time optimization controls. The employment of production logging tools and data from production history, flow tests, downhole gauge readings, zonal production allocation, and well performance analysis may be inferred and the increasing or optimization of hydrocarbon production can be achieved with adjustments of the ICVs. However, the ability to infer zonal oil and water contribution from different laterals with simple surface measurements, without having to perform downhole metering (involving attendant cabling, downhole electronic devices, and associated costs) may still be highly desirable.

Figure 2:
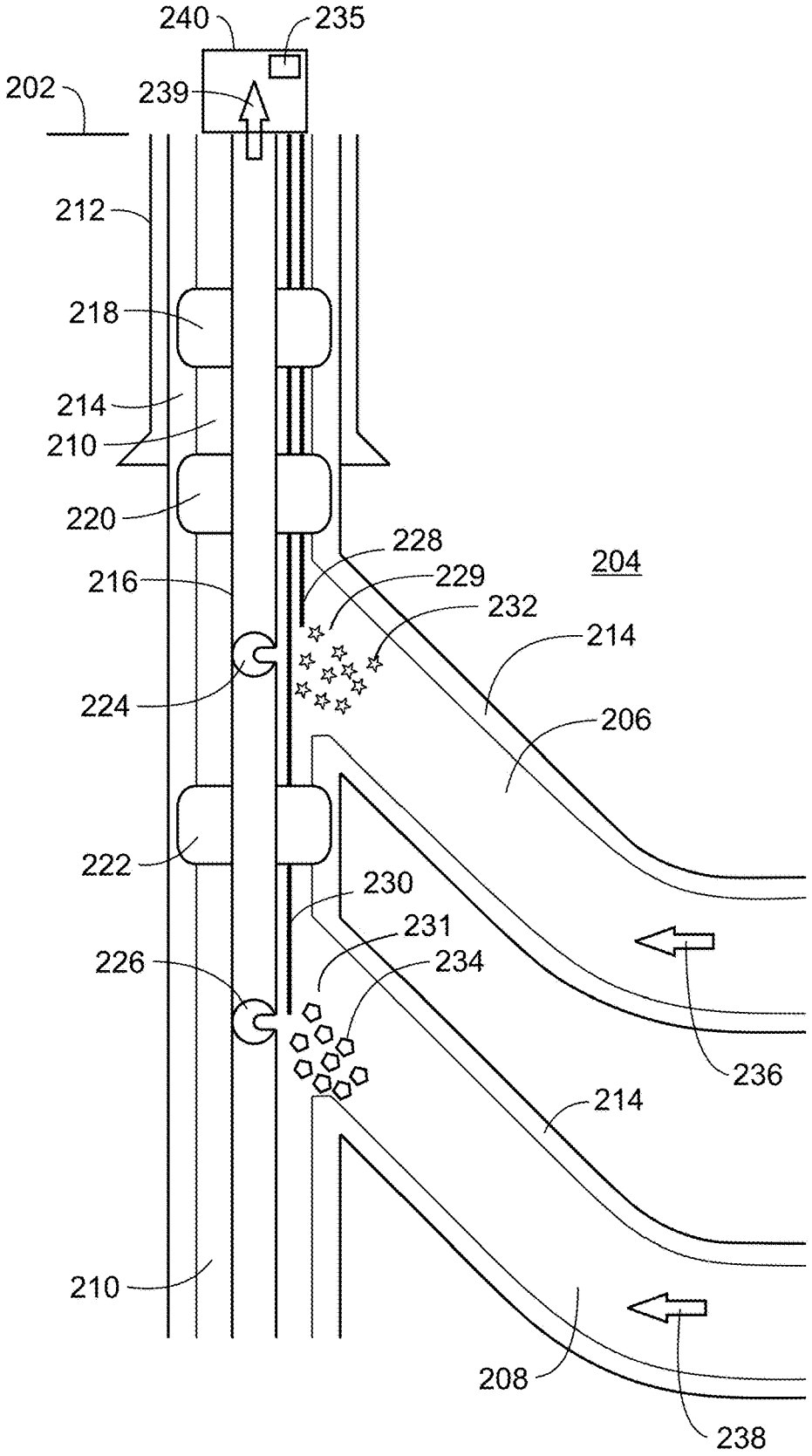
FIG. 2 is a diagram a wellbore formed through the Earth surface into a subterranean formation in the Earth crust.

As indicated in FIG. 2, a different technique may measure at surface the zonal oil and water contribution to fluid flow without disruption to production. By installing a passive capillary dosing line (e.g., permanent or substantially permanent) from the surface during well completion, selectively soluble tracers can be injected from the wellhead into the different zones during routine well performance diagnostics. An abrupt tracer dosing shut off would generate the transient in tracer concentrations as the production flows carry the tracers to the surface, obviating the need to shut in the well.

FIG. 1 and FIG. 2 provide for a comparison of features between selective soluble tracers dosed via capillary dosing lines from the surface (FIG. 2) and a controlled-release resin installed as part of the completion (FIG. 1). The technique indicated by FIG. 1 generally needs a well shut-in for measurement and analysis. The technique indicated by FIG. 2 generally can avoid a well shut-in for measurement and analysis.

FIG. 1 is a wellbore 100 formed through the Earth surface 102 into a subterranean formation 104 of the Earth crust. The wellbore 100 has a vertical portion and two laterals including a first lateral 106 and a second lateral 108.

The wellbore 100 includes a borehole 110 and a borehole wall 114 (wellbore wall) at the interface with subterranean formation 104. The wellbore 100 may include casing 112 (reservoir casing) disposed along the borehole wall 114. The borehole wall 114 may be reservoir rock in the openhole case, or casing or metal liner in the reservoir rock in cased portions of the wellbore. The wellbore 100 may include production tubing 116 disposed in the borehole 110.

Portions of the wellbore 100 can be an open completion. For example, vertical portions can be openhole and/or the laterals can be openhole. The wellbore 100 can be generally a cased completion. This top casing is depicted, but the casing go further down along the vertical portion to at least the laterals. While not fully shown for clarity, the casing 112 may generally run the length of the vertical portion of the wellbore 100, and in some cases, along the two laterals 106 and 108. Moreover, it should be noted that while only two laterals are depicted, the wellbore 100 may have more than two laterals.

During production, produced fluid may flow from the subterranean formation 104 into the laterals 106, 108. The produced fluid (e.g., hydrocarbon) may flow, for example, through the openhole borehole wall 114 into the lateral, or for a cased completion of the laterals, through perforations (not shown) in the casing 112 into the lateral. The hydrocarbon produced via the first lateral may include crude oil or natural gas, or both. The hydrocarbon produced via the second lateral may include crude oil or natural gas, or both. The produced fluid can include water in implementations.

Production tubing 116 may be situated in the borehole 110 in the vertical portion of the wellbore 100. The wellbore 100 may have packers, such as the depicted isolation packers including a first packer 118, a second packer 120, and a third packer 122. A purpose of the first packer 118 may be a redundancy of additional sealing in case leakage across the second packer 120.

The illustrated implementation includes two valves (first valve 124 and second valve 126) disposed along the production tubing 116 to receive produced fluid from the two laterals, respectively, into the production tubing. The first valve 124 and the second valve 126 may each be, for example, an interval control valve (ICV). In implementations, interval or flow control valves can be operated automatically, manually, or remotely as part of an intelligent completion. Utilized to control multiple zones (laterals) selectively, the ICVs may reduce water cut and gas cut, reduce well interventions, and increase well productivity. Intelligent completions may address completion challenges (and reservoir management tasks) arising from deviated, extended-reach, multi-targeted, or multilateral wells.

A first resin 128 (e.g., a resin pack) is disposed in the borehole 110 to release a first taggant 130 (first tracer) into the first produced fluid 132 flowing from the first lateral 106. The first taggant 130 may be gradually release from the resin pack as the resin pack is exposed to target wellbore fluids, such as water and/or hydrocarbon. A second resin 134 (e.g., a resin pack) is disposed in the borehole 110 to release a second taggant 136 (second tracer) into the produced fluid 138 flowing from the second lateral 108. The second taggant 136 may be gradually released from that resin pack as the resin pack is exposed to target wellbore fluids, such as water and/or hydrocarbon. The second taggant 136 may be different from the first taggant 130. A temporary well shut-in is generally required, for example, at about 8 hours to 72 hours to accumulate the taggants 130, 136 to build up the concentration of the respective taggant in each zone. Then, as the well is reopened, pulses of the taggants 130, 136 (e.g., dyes) indicating respective production of the two zones will be produced in proportion to the respective lateral influx rate. The rate of gradual release of the taggants 130, 136 from the respective resin pack may be approximated but exact rate is generally not needed in the evaluation, as the taggants 130, 136 are allowed to build up and then suddenly released.

The first produced fluid 132 and the second produced fluid 138 are produced from (flow from) the subterranean formation 104 into first lateral 106 and the second lateral 108, respectively. The first produced fluid 132 and the second produced fluid 138 each may generally include hydrocarbon, such as crude oil and/or natural gas. The first produced fluid 132 and the second produced fluid 138 may each include water.

In operation, the first valve 124 receives the first produced fluid 132 at a flow rate Q1 from the first lateral 106 into the production tubing 116. The second valve 126 receives the second produced fluid 138 at a flow rate Q2 from the second lateral 108 into the production tubing 116. The flow rates Q1 and Q2 may each be, for example, volume per time. The combined flow (Q1 and Q2) of the produced fluid 132, 138 is upward through the production tubing 116 toward uphole and exits the wellbore 100 by discharging from the borehole 110 through a wellhead 140 at the surface 102. The combined stream of the produced fluid 132, 138 may be analyzed to detect the taggants 132, 138 to determine the relative contribution of the first produced fluid 136 and the second produced fluid 138 to the combined stream. A well shut-in is generally required for analysis/calculation. As the tracers are being continually released from the resin, there is thus generally a need to generate a pulse via shutting in the well for a time for the tracers to accumulate (build up), then released when the well shut-in is stopped and well allowed to produce.

Without a shut-in of the well, there would generally be no transient in tracer concentrations from, for example, two different zones. In other words, with no well shut-in, the tracers released into the different zones may be constantly released in steady state to the surface and thus without meaningful information for each zone from the tracer dye signal at the surface because the flows are comingled from all the laterals (e.g., the two different zones).

FIG. 2 is a wellbore 200 formed through the Earth surface 202 into a subterranean formation 204 of the Earth crust. The wellbore 200 has a vertical portion and two laterals including a first lateral 206 and a second lateral 208.

The wellbore 200 includes a borehole 210 in the vertical portion and in the laterals. The wellbore 200 has casing 212 and borehole wall 214 along the borehole 210. For openhole, the borehole wall 214 is the subterranean formation 204 (e.g., reservoir rock). For presence of casing, the borehole wall 214 (or wellbore wall) can be the casing or metal liner embedded in the subterranean formation 204 along the perimeter of the borehole 210.

While not fully shown for clarity, the casing 212 may generally run the length of the vertical portion of the wellbore 200 (vertical portion of the borehole 210), and in some implementations, along the two laterals 206 and 208. During production, produced fluid may flow from the subterranean formation 204 into the laterals 206, 208.

Production tubing 216 may be situated in the borehole 210 in the vertical portion of the wellbore 200. The wellbore 200 may have packers, such as the depicted isolation packers including a first packer 218, a second packer 220, and a third packer 222. Further, the illustrated implementation includes two valves (first valve 224 and second valve 226) disposed along the production tubing 216 to receive produced fluid from the two laterals, respectively, into the production tubing 216. The first valve 224 and the second valve 226 may each be, for example, an ICV, as discussed with respect to FIG. 1.

A first dosing tubing 228 (e.g., capillary dosing line) runs from the surface 202 into the wellbore 200 (into the borehole 210) to the intersection of the first lateral 206 with the vertical portion of the wellbore 200. The term "capillary" here may not refer to capillary hydraulic action but simply mean the tubing as having a relatively narrow or small diameter, e.g., an inside, nominal, or outside diameter in a range of 0.1 inch to 0.5 inch.

A second dosing tubing 230 (e.g., capillary dosing line) runs from the surface 202 into the wellbore 200 (into the borehole 210) to the intersection of the second lateral 208 with the vertical portion. Again, the dosing tubing 228, 230 may be small in diameter, such as having a nominal diameter of less than 1 inch or less than 0.5 inch, such is the ranges of 0.1 inch to 0.5 inch, or 0.1 inch to 0.3 inch.

Taggants (tracers) 232, 234 may be applied from surface 202 through the dosing tubing 228, 230 into the borehole 210. In implementations, a surface pump(s) 235 at the surface 202 may provide motive force for flow of the taggants 232, 234 through the dosing tubing 228, 230 into the borehole 210. The first taggant 232 is different from the second taggant 234. For respective tests (evaluations) with the first taggant 232 and the second taggant 234 conducted contemporaneously (simultaneously), the first taggant 232 versus the second taggant 234 should generally be different with respect to each other so that can be distinguished with respect to each other in detection. The first taggant 232 and the second taggant 234 can be the same, for instance, with the respective tests (evaluations) performed in series in time, such as each lateral examined one-by-one in series in time with waiting for the previously applied taggant to dissipate between tests.

A carrier fluid may be utilized in the application (injection) the first taggant 232 through the first dosing tubing 228 and the second taggant 234 through the second dosing tubbing 230. The carrier fluid may be, for example, water (e.g., called injection water) (e.g., seawater, tap water, deionized water etc.) or a polar solvent with high boiling point (e.g., at least 150° C., or in the range of 150° C. to 30° C.) and low volatility. An example of a polar solvent for the carrier fluid is ethylene glycol. The taggants 232, 234 may be liquid and dissolve (in solution) in the carrier fluid and in the wellbore fluid (produced fluid).

The first taggant 232 (first tracer) may be provided via the first dosing tubing 228 to an intersection region 229 of the wellbore vertical portion and the first lateral 206. Thus, the first taggant 232 discharges from the first dosing tubing 228 into the first produced fluid 236 flowing from the first lateral 206 toward the production tubing 216. The first taggant 232 may be provided via the first dosing tubing 228 to adjacent to the first valve 224. The amount (e.g., volume or mass) and flow rate (e.g., volume per time or mass per time) of the first taggant 232 through the dosing tubing (tube) 228 into the wellbore 200 may be specified (as implemented) and known. The amount or rate of dosed taggant may be considered, such as with respect to an amount beneficial to reach the surface with adequate concentration to be detectable and to measure the decay, for example, of 1-2 orders of magnitude or more.

The second taggant 234 (second tracer) may be provided via the second dosing tubing 230 to an intersection region 231 of the wellbore vertical portion and the second lateral 208. Thus, the second taggant 234 discharges from the second dosing tubing 230 into the second produced fluid 238 flowing from the second lateral 208 toward the production tubing 216. The second taggant 234 may be provided to adjacent to the second valve 226 in the region of the intersection of the vertical portion and the second lateral 208. The amount (e.g., volume or mass) and flow rate (e.g., volume per time or mass per time) of the second taggant 234 through the dosing tubing (tube) 230 into the wellbore 200 may be specified and known. Again, the taggants 232, 234 may be applied (injected) in the aforementioned carrier fluid through the dosing tubes 228, 230 into the wellbore 200.

The flow rates of each taggant 232, 234 as injected may be, for example, in the range of 0.1 gallon per minute (gpm) to 0.5 gpm. The concentration of the taggants 232, 234 in the produced fluid at surface 102 may generally depend on the amount of the taggant injected. Knowing or specifying the flow rates (mass or volume) of the dosed taggants 232, 234 as applied may facilitate evaluating the taggant concentration (maximum taggant concentration) in the produced at surface. It may be beneficial to measure down to a few percent (e.g., less than 3% by volume or weight) in the produced fluid to map out the decay rates of the taggant concentration once the taggant dosing is shut off. The amount of taggant dosed may be related to detection of the taggant. Moreover, the rate of dosed taggant may be specified to facilitate a saturated concentration of the taggant to generate pulses of dyes indicating the two zones.

The taggants 232, 234 (tracers) may be soluble in water and characterized as water-soluble. The taggants 232, 234 may be water-soluble naphthalene sulfonates, water-soluble pyrene sulfonate derivatives, or water-soluble anthracene sulfonates, or any combinations thereof. In particular, as supported by the Example below, the water-soluble taggants 232, 234 (tracers) may include, for example, at least one of the following seven tracers: 1,5-NDS, ANS, 2,7-NDS, 2-NS, ANTS, Pyranine, or PTSA.

As indicated with respect to FIG. 1, in operation for FIG. 2, the first produced fluid 236 and the second produced fluid 238 are produced from (flow from) the subterranean formation 204 into the first lateral 206 and the second lateral 208, respectively. The first produced fluid 236 and the second produced fluid 238 may each include water and/or hydrocarbon (e.g., crude oil and/or natural gas).

In operation, the first valve 224 receives the first produced fluid 236 at a flow rate Q1 from the first lateral 206 into the production tubing 216. The second valve 226 receives the second produced fluid 238 at a flow rate Q2 from the second lateral 208 into the production tubing 216. The flow rates Q1 and Q2 may each be, for example, volume per time, and may be analogous to Q1 and Q2 discussed with respect to FIG. 1. The combined flow (flow rates Q1 and Q2) of the produced fluid 236, 238 of the discharge stream 239 is upward through the production tubing 216 toward uphole and exits the wellbore 200 by discharging from the borehole 210 through a wellhead 240 at the surface 202.

This discharged produced stream 239 of the combined produced fluid 236, 238 (total flow rate=Q1+Q2) may be analyzed to detect or measure the taggants 232, 234 (tracers) in the produced stream 239 to determine the relative contribution of the first produced fluid 236 (and/or water in the first produce fluid 236) and the second produced fluid 238 (and/or water in the second produced fluid 238) to the produced stream 239 (combined produced fluid 236 and 238) that discharges at the surface 202. Again, the tracers 232, 234 are water-soluble and thus generally in the water phase in the first produced fluid 236 and in the second produced fluid 238.

The taggants 232, 234 in the produced stream 239 may be measured or detected, for example, via optical detection (optical measurement) or other measurement techniques. Optical measurement may refer to noncontact measurement utilizing light sources. Optical detection/measurement can employ at least one lens, a light source, and a detector. Optical measurement may be a measurement technique that relies on the use of optical sensors to collect measurements. Several different types of systems (analytical instruments) are available for optical detection, including fully automated ones, as well as systems that allow for more manual control. Optical measurement can be noninvasive. The features of excitation and emission can be involved.

An online analytical instrument (e.g., for performing optical detection or other types of measurements) may be employed to automatically sample the produced stream 239 for measurement in the field of the taggants 232, 234 (e.g., in near real time). On the other hand, a sample of the produced stream 239 may be manually collected by a human operator or technician and subjected to analysis (e.g., optical detection or other measurement technique) for the taggants 232, 234 via a laboratory analytical instrument (e.g., in a mobile laboratory at the well site having the wellbore 200).

The analytical instruments and techniques for detection or measurement (e.g. optical) of the water-soluble taggants (tracers) may include chromatographic and spectrometric techniques for the separation of the taggants from dissolved organic matter interferents in the aqueous phase of the produced fluids. The spectrometric technique may be the optical detection, such as by measuring either an absorbance or a fluorescence spectrum of the material. The chromatographic technique may be optical detection, involving separating the compounds utilizing a chromatographic column first, then quantify by optical detection (e.g. HPLC).

In implementations, the detection of the taggants 232, 234 in the produced stream 234 may be at trace concentrations [e.g., less than 1 part per million (ppm) by weight or volume] and ultra-trace concentrations (e.g., less than 0.1 ppm by weight or volume). The detection may be beyond mere detection indicating as present or not, but instead is measurement giving numerical values of concentration so to be able to quantify the material in order to calculate the decay rate.

In particular, for the optical detection, two-dimensional (2D) high-pressure liquid chromatography (HPLC) may be employed. Specifically, an inline solid phase extraction-2D-HPLC inline analysis technique may be applied for determining the concentrations of the taggants in the target fluid phase from each lateral. The solid phase extraction may be applied for sample preparing, and the 2D HPLC applied for analysis to measure taggants (tracers).

In implementations, a well shut-in (shut-in of the wellbore 200) is generally not implemented for the measurements of the discharged produced stream 239 at surface 202 for the taggants 232, 234. In other words, transients may generated with the dosing procedure of the taggants. For example, the actions of the dosing procedure that generate a transient may include, for instance, an abrupt discontinuing of the dosing, injecting a pulse of increased rate or taggant concentration, increasing concentration, and the like. This may be a significant aspect of embodiments herein because the dosing is performed from the surface, facilitating the control of injecting a pulse, an abrupt shutoff, rising concentration, etc. Thus, in implementations herein, a well shut-in is not performed in the dosing and evaluation. This is different from the resin packs (e.g., FIG. 1) because the resin pack is inaccessible downhole in operation and in a limited way, gradually releases the tracer continuously, therefore generally requiring a well shut-in to generate a transient for evaluation.

The dosing procedure may include: [1] injecting the first taggant 232 (e.g., in a carrier fluid) through the first dosing tubing 228 (conduit) to the first lateral 206 and adjacent the valve 224; [2] injecting the second taggant 234 (e.g., in a carrier fluid) through the second dosing tubing 230 (conduit) to the second lateral 208 and adjacent the valve 226; [3] abruptly stopping injection to generate a transient; and [4] measuring the amount and flow rate of the taggants 232, 234 (tracers). The measurement and calculation procedure may include: [A] measuring concentrations of the taggants 232, 234 (tracers) in the produced stream 239; and [B] calculating the amount of the first produced fluid 236 and the amount of the second produced fluid 238 based on the amount and rate of taggants 232, 234 injected and based on the concentrations of the taggants 232, 234 in the produced stream 239. The decay rate of the taggant after the transient indicates how fast (e.g., mass or volume per time rate) the taggant is being flushed out, e.g. how fast the fluid (mass or volume per time rate) is coming from the lateral. The ratio of these decay rates may indicate the ratio of flows from each lateral. The technique may include determining a volume ratio of the first produced fluid in the produced stream to the second produced fluid in the produced stream based on the amount of the first tracer in the produced stream as measured and the amount of the second tracer in the produced stream as measured. The amount of water (water-cut) is generally not determined by this technique alone, but can be with technique combined with an adjustment of the ICV or other operational factors.

Field validation has been performed that field-validates water-soluble tracers that can be detected at ultra-trace levels with an automatable analysis system, for example, HPLC with inline optical detection. See, e.g., Ow et al., "First Deployment of a Novel Advanced Tracers System for Improved Waterflood Recovery Optimization," ADIPEC Exhibition and Conferences, Abu Dhabi, UAE, 12-15 Nov. 2018, SPE-192598-MS; Ow et al., "Automatable High Sensitivity Tracer Detection: Toward Tracer Data Enriched Production Management of Hydrocarbon Reservoirs," SPE Annual Technical Conference and Exhibition, Dubai, UAE, 21-23 Sep. 2021; Thomas et al., "Deployment and Detection of a Novel Barcoded Advanced Tracers System for the Optimization of Improved Waterflood Recovery in Hydrocarbon Reservoirs," SPE Middle East Oil & Gas Show and Conference, Manama, Bahrain, 18-21 Mar. 2019, SPE-194872-MS.

Embodiments include a class of highly water-soluble naphthalene sulfonate and pyrene sulfonate derivatives, and moderately water-soluble anthracene sulfonates, that can be analyzed utilizing an automated system for uniquely tagging the aqueous phase of the reservoir fluids from each lateral. Embodiments may include water-soluble tracer/taggant materials that can be injected into each lateral of the well to tag the aqueous phase of the reservoir fluids. Each class of materials may be described for its suitability as a produced water taggant in terms of: (i) simplicity of detection modality, which may have implications with respect to a field analysis instrument, (ii) detection sensitivity in produced water matrix, (iii) short-term stability under downhole condition and long-term stability in reservoir condition, and (iv) ease of commercialization or availability of commercial sources for the materials. The taggant may be dissolved in water that facilitates them to be delivered to the laterals via the dosing lines. The taggants may include known compounds that are commercially available, as well as novel compositions that have not been applied to this purpose of tagging different phases of reservoir fluids for quantification of (quantifying) zonal flow contributions in multilateral wells.

This disclosure also describes the formulation of a carrier fluid that facilitates injection of the taggant via the capillary dosing tube (from the surface) into the different zones in the reservoir. For water-soluble taggants, the carrier fluid may include injection water (e.g., seawater, tap water, deionized water etc.) or a polar solvent with high boiling point and low volatility, such as ethylene glycol.

This disclosure outlines the chromatographic and spectrometric techniques for the separation of the taggant materials from dissolved organic matter interferents in the aqueous and oil phases of the produced fluids and their detection at trace and ultra-trace concentrations. In particular, 2D HPLC may be employed. Specifically, an inline solid-phase extraction-2D-HPLC inline analysis technique may be applied for determining the concentrations of the taggants in the target fluid phase (e.g., the discharge stream 239 of FIG. 2) received as combined flow from each lateral.

The concentrations of the taggants dosed into the laterals and collected with the produced fluids at the surface over a prescribed time duration may be utilized to quantitate (quantify) the contributions of fluids from each lateral in the assessment of production efficiency. Data from the calculated zonal flow contribution may inform and aid the subsequent adjustments of production parameters to improve reservoir management and increase hydrocarbon recovery.

Water-soluble molecular taggants are described herein as developed, in part, by considering the competency of naphthalene sulfonate (NS)-based and pyrene sulfonate (PS)-based compounds as water soluble, optically detectable tracers using the automated SPE-2D HPLC for analysis and detection.

Solid-phase extraction (SPE) can be a sample preparation technique routinely utilized in analytical laboratories for the extraction of analytes from a complex matrix. This sample preparation technique facilitates the extraction, cleanup and concentration of analytes prior to their quantification.

NS-based and PS-based tracers are chemically stable, highly water-soluble, and strongly luminescent. The compounds may be excellent tracer candidates for deep geothermal reservoirs and, as specified for embodiments, tracer candidates for inter-well water tracers for carbonate reservoirs. The high water-solubility of the tracers, although very desirable for subsurface transport in injection water, can make chromatography separation challenging. Therefore, specific HPLC separation methods as prescribed herein in embodiments, such as ion-pairing chromatography, for NS-based and PS-based tracers may be implemented.

Embodiments accommodate the analysis burden of injecting NS-based unique tracers in multiple injector-producer pairs by processing standards of these tracers through the automated SPE stage of the analysis protocol. The selection of suitable SPE cartridges to extract tracers efficiently from the produced water may be beneficial. Additionally, technique development for HPLC chromatographic separation is outlined to facilitate integrated sample preparation by SPE, and analysis and detection by 2D-LC fluorescence quantification system. The 2D-LC is a type of HPLC. The fluorescence detector that is part of the HPLC system may provide for the optical detection. For the technique, the fluorescence quantification system may involve utilization of a single wavelength for each tracer, although with capability to utilize spectroscopy if beneficial.

Solid phase extraction (SPE) may be an extractive technique by which compounds that are dissolved or suspended in a liquid mixture are separated from other compounds in the mixture according to their physical and chemical properties. Analytical laboratories may employ SPE to concentrate and purify samples for analysis. In implementations, SPE can be utilized to isolate analytes of interest from a wide variety of matrices. Solid phase extraction (SPE) may be a technique designed and configured for rapid, selective sample preparation and purification prior to chromatographic analysis (e.g. HPLC, GC, TLC, etc.).

Figure 3:
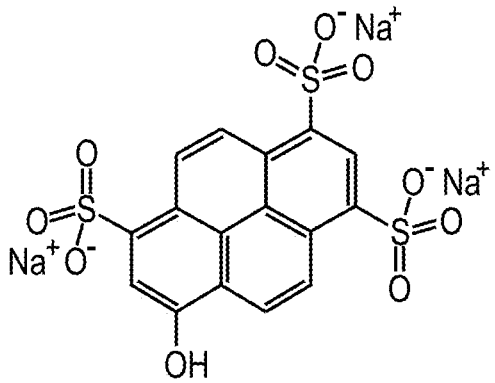
FIG. 3 gives diagrams of seven taggants (tracers) applicable for embodiments of the present techniques.
Figure 3:
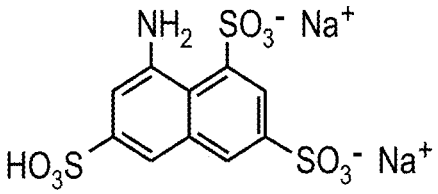
Figure 3:
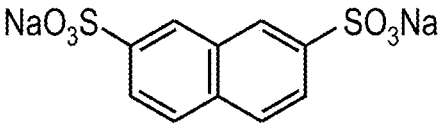
Figure 3:
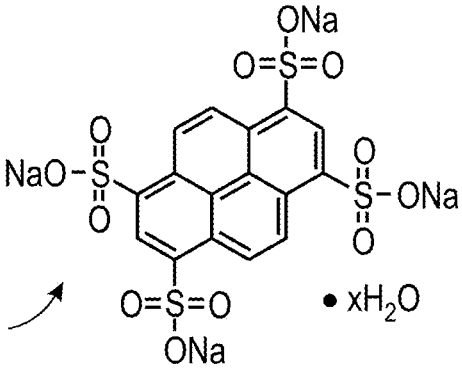
Figure 3:
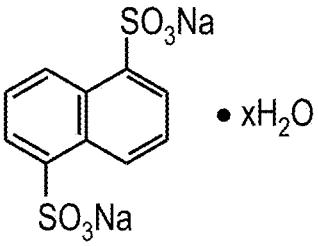
Figure 3:
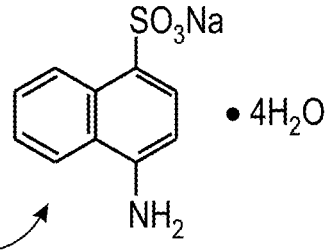
Figure 3:
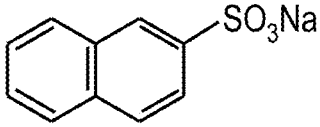

FIG. 3 depicts seven taggants (tracers) applicable for embodiments of the present techniques. The depicted seven taggants are water-soluble and are mentioned above. The taggants include naphthalene sulfonate derivatives and pyrene sulfonate derivatives, and anthracene sulfonates derivatives. The naphthalene sulfonate derivatives are different chemical compounds than the pyrene sulfonate derivatives. The naphthalene sulfonate as derivatives (chemical derivatives) and the naphthalene sulfonate as derivatives (chemical derivatives) may be naphthalene sulfonate functionalized (including isomers) and pyrene sulfonate functionalized (including isomers), respectively, as candidates for taggants. Anthracene sulfonate derivatives may be characterized as naphthalene sulfonate derivatives (NS) herein.

The taggant 300 is Pyranine. The International Union of Pure and Applied Chemistry (IUPAC) name is Trisodium 8-hydroxypyrene-1,3,6-trisulfonate. The excitation for the taggant 300 is 455 nm. The emission of the taggant 300 is 515 nm. Pyranine is a pyrene sulfonate derivative.

The taggant 302 is 8-Aminonaphthalene-1,3,6-trisulfonic acid, disodium salt (ANTS). Excitation is 245 nm. Emission is 445 nm. ANTS is an anthracene sulfonate, which can be characterized as a naphthalene sulfonate (NS) for purposes herein.

The taggant 304 is Disodium 2,7-naphthalenedisulfonate (2,7-NDS). Approximate pricing is US $59 per 25 grams (g). Approximate bulk pricing is US $33,230 per 20 kilograms (kg). Excitation is 226 (or 276) nm. Emission is 339 nm. 2,7-NDS is a naphthalene sulfonate.

The taggant 306 is 1,3,6,8-Pyrenetetrasulfonic acid (PTSA) ($C_{16}H_{10}O_{12}S_4$) also called 1,3,6,8-Pyrene tetrasulfonate. Excitation is 375 nm. Emission is 505 nm (or 445 nm). PTSA is a pyrene sulfonate derivative.

The taggant 308 is Disodium 1,5-naphthalenedisulfonate hydrate (1,5-NDS). Approximate pricing is US $20 per 25 g. Approximate bulk pricing is US $2,615 per 20 kg. Excitation is 219 nm. Emission is 334 nm. 1,5-NDS is a naphthalene sulfonate.

The taggant 310 is Sodium 4-amino-1-naphthalenesulfonate tetrahydrate (ANS). Approximate pricing is US $19 per 25 g. Approximate bulk pricing is US $3,400 per 20 kg. Excitation is 327 nm. Emission is 430 nm. ANS is a naphthalene sulfonate.

The taggant 312 is Sodium 2-naphthalenesulfonate (2-NS). Approximate pricing is US $86 per 25 g. Approximate bulk pricing is US $59 per 20 kg. Excitation is 220 nm. Emission is 336 (or 405) nm. 2-NS is a naphthalene sulfonate.

As appreciated by one of ordinary skill in the art, the excitation and the emission are utilized in the optical detection. Excitation is the light that is shined on the molecule at a specific wavelength in order to cause fluorescence. Emission is the resulting light generated by the molecule and is at a different wavelength.

Fluid samples from a hydrocarbon (e.g., crude oil) reservoir are typically highly complex, consisting of many dissolved organic matters. For example, polycyclic aromatic hydrocarbons, which have a multitude of chemical functionalities, commonly manifest as high background fluorescence signals in optical detection methods, obfuscating the detection of the analytes of interest. To separate and detect the taggant (tracer) materials effectively from this background signal, embodiments may rely on the powerful 2D-LC separation, where a second column affords orthogonal selectivity and additional capacity of separation.

Figure 4:
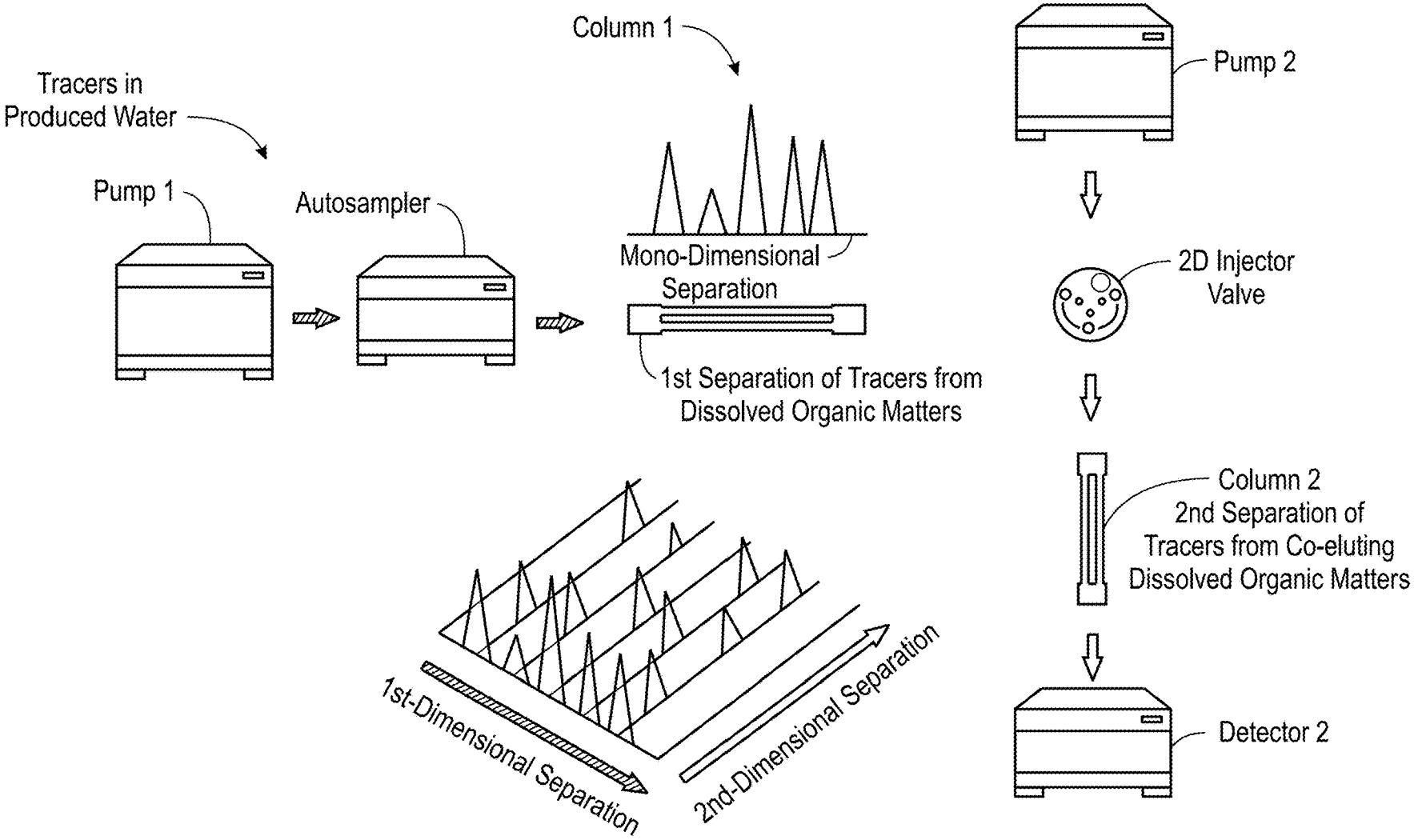
FIG. 4 is a diagram of basic technique of two-dimensional liquid chromatography (2D-LC).

FIG. 4 shows the basic principle of 2D-LC. FIG. 4 is a schematic on the operating principle of 2D-LC in which the sample containing the analyte of interest undergoes two chromatographic separations. Peaks of interest from the one dimensional (1D)-LC, either identified by retention time or a predetermined signal threshold, are fractionated in-line and sent into the parking deck before being injected sequentially into a second column for further separation. If the fractionated samples from the 1D-LC contain co-eluting species, the 2D separation should resolve them with a judicious choice of mobile and stationary phases. For produced water samples from a hydrocarbon reservoir, this facilitates effective isolation of the tracer compounds from other polycyclic aromatic hydrocarbons present in the fluids, suppressing background signals and facilitating high sensitivity detection of the tracers down to trace concentration levels.

Figure 5:
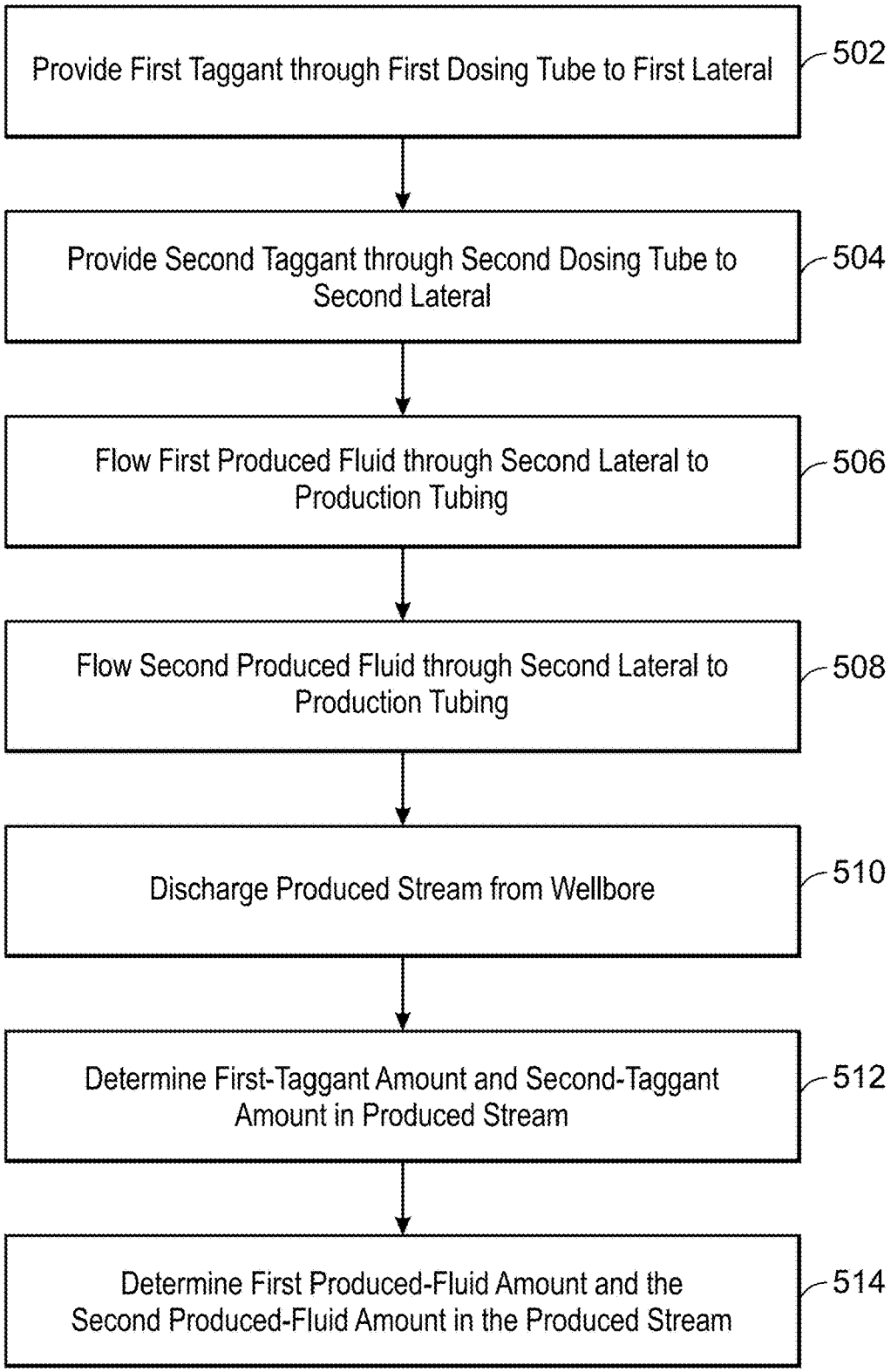
FIG. 5 is a block flow diagram of a method of quantifying zonal flow in a multi-lateral well.

FIG. 5 is a method 500 of quantifying zonal flow in a multi-lateral well. The multi-lateral well includes a wellbore formed through the Earth surface into a subterranean formation in the Earth crust. The wellbore includes a vertical portion and at least two laterals (first lateral and second lateral). The laterals can be known as zones. The produced fluid from the first lateral (first zone) may include hydrocarbon (e.g., crude oil and/or natural gas) and water. The produced fluid from the second lateral (second zone) may include hydrocarbon (e.g., crude oil and/or natural gas) and water.

At block 502, the method includes providing a first taggant (tracer) from the Earth surface through a first dosing tubing (e.g., a first capillary dosing line) to a first lateral in the wellbore. The first taggant may be intended to tag produced fluid from the first lateral so that this produced fluid can be identified. A purposed of providing (injecting) the first taggant may be to tag fluid that is produced via the first lateral. This produced fluid flows through the first lateral from the subterranean formation to the production tubing.

The first taggant may be provided from the Earth surface through the first dosing tubing to a first region associated with the first lateral. The first region may be a region of intersection of the first lateral with the vertical portion. The first taggant may discharge from the first dosing tubing into the wellbore (e.g., into the first region), such as near or adjacent to a first valve (e.g., first ICV) disposed along production tubing in the vertical portion of the wellbore.

A pump at the surface may be utilized to provide motive force for flow of the first taggant through the first dosing tubing. As discussed, for dosing tubing labeled as a capillary line herein, no capillary action is generally utilized as motive force for taggant flow through dosing tubing, but instead refers to the dosing tubing as a small diameter tubing.

At block 504, the method includes providing a second taggant (tracer) from the Earth surface through a second dosing tubing (e.g., a second capillary dosing line) to a second lateral in the wellbore. The second taggant may be intended to tag produced fluid from the second lateral so that this produced fluid can be identified. A purpose of providing (injecting) the second taggant may be to tag fluid that is produced via the second lateral (and flows through the second lateral from the subterranean formation to the production tubing).

The second taggant may be provided from the Earth surface through the second dosing tubing to a second region associated with the second lateral. The second region may be a region of intersection of the second lateral with the vertical portion of the wellbore. The second taggant may discharge from the second dosing tubing into the wellbore (e.g., into the second region), such as near or adjacent to the second valve (e.g., second ICV) disposed along the production tubing. A pump at the surface may be utilized to provide motive force for flow of the second taggant through the second dosing tubing.

The first taggant and the second taggant are water-soluble. The first taggant may be different from the second taggant. The first taggant and the second taggant may each be at least one of a naphthalene sulfonate, a pyrene sulfonate derivative, or an anthracene sulfonate. The first taggant and the second taggant each may be at least one of 1,5-NDS, 2,7-NDS, 2-NS, ANS, ANTS, Pyranine, or PTSA.

At block 506, the method includes flowing (producing) a first produced fluid (having hydrocarbon and water) from the subterranean formation via (through) the first lateral through the first valve (e.g., ICV) into the production tubing in the wellbore. Again, the production tubing may be in a vertical portion of the wellbore.

At block 508, the method includes flowing a second produced fluid having hydrocarbon and water from the subterranean formation via the second lateral through the second valve (e.g., ICV) into the production tubing. As mentioned, the first valve and the second valve may be disposed along production tubing to receive fluid into the production tubing.

At block 510, the method includes flowing (producing) a produced stream including the first produced fluid and the second produced fluid uphole through the production tubing and discharging the produced stream from the wellbore. Producing the first produced fluid may involve flowing the first produced fluid from the first lateral through the first valve into the production tubing, and producing the second produced fluid may involve flowing the second produced fluid through the second valve into the production tubing, wherein the first valve and second valve are disposed along the production tubing. The first produced fluid and the second produced fluid combine in the production tubing, and the combination discharges at surface as the produced stream from the production tubing and the wellbore.

At block 512, the method includes analyzing the produced stream (e.g., at Earth surface) to determine (measure) an amount (first-taggant amount) of the first taggant in the produced stream and an amount (second-taggant amount) of the second taggant in the produced stream.

For the analysis, a sample of the produced stream may be collected and prepared. SPE may be employed in the sample preparation.

Then, optical detection, chromatography, and/or spectrometry may be utilized in the analysis of the prepared sample for measuring the amount of first taggant and the amount of the second taggant in sample (and thus determining the respective amounts of first taggant and second taggant in the produced stream). As discussed, an example for the analysis is 2D-HPLC. The method may include determining a volume ratio of the first produced fluid in the produced stream to the second produced fluid in the produced stream based on the amount of the first tracer in the produced stream as measured and the amount of the second tracer in the produced stream as measured.

At block 514, the method includes determining (e.g., calculating) an amount of the first produced fluid (the first produced-fluid amount) in the produced stream and an amount of second produced fluid (the second produced-fluid amount) in the produced stream based on the amount of the first taggant in the produced stream as measured and the amount of the second taggant in the produced stream as measured. For the calculations, the decay rate of each taggant is measured over a period of time. The ratio of the decay rates, multiplied by the total flow rate, gives the flow rate of each produced stream.

EXAMPLE

Analysis of the aforementioned seven taggants (tracers) (1,5-NDS, 2,7-NDS, 2-NS, ANS, ANTS, Pyranine, and PTSA) may involve SPE cartridge selection and an experimental procedure. As a sample preparation technique, SPE has high automation potential in addition to its strength on selectivity and flexibility. For the analysis of the aforementioned seven tracers in this Example, the selection of an effective SPE cartridge for specific tracer molecules may be important. There are at least four general modes of extraction utilized in SPE techniques. Reversed phase, normal phase and ion exchange employ different sorbent types, namely hydrophobic, hydrophilic, ion-exchange and mixed mode. The polymer-based sorbents are available in a wide range of chemistries, covering a broad spectrum of polarities. The most non-polar sorbents are often based on styrene-divinylbenzene copolymers, sometimes further modified to create ion-exchange sorbents through amination or sulfonation. Other polymers incorporate polar functional groups, which make the sorbents water-wettable, and offers additional possibilities for retention mechanisms.

Sorbent selection was implemented with consideration of sample volume, the nature of the analyte, analyte concentration and the inherent properties of the sorbent itself. The selected sorbent should have an excellent affinity for the compounds of interest and, at the same time, a weak affinity for irrelevant compounds within the matrix. Choosing the correct sorbent results in a specific selectivity for the compounds of interest. Adequate loading capacity also can be identified to increase or optimize retention amount of the desired compound. For instance, Strata® X-RP SPE column with reversed phase functionalized polymeric sorbent gives strong retention of neutral, acidic, or basic compounds under aggressive, high organic wash conditions. This sorbent relies on 3 mechanisms of retention: π-π bonding, hydrogen bonding (dipole-dipole interactions), and hydrophobic interaction. Strata® X-RP SPE is available from Phenomenex Inc. having headquarters in Torrance, California, USA.

In this Example, results on the SPE cartridge selection for complex mixtures of NS-based tracers are summarized. To evaluate the SPE procedures, experiments were generally performed with a preconcentration factor of at least 100 times in solution—e.g., starting from a concentration of tracer molecules at 100 nanomolar (nM) and expecting to be concentrated to 10 micromolar (μM). The recovery factors were determined by UV-vis or HPLC analysis.

The discussion now turns to the SPE Processing of the tracer mixture solution. Due to the various chemical properties of these NS-based tracers, which includes polarity as well as aromaticity, efficient extraction of these compounds may benefit from different types of SPE cartridges with different extraction capacities. Fortunately, Strata X-RP SPE cartridge has been reported in the literature to extract all the tracer molecules of interest. The SPE processing in the Example included the following five steps:

1. Prepared tracer stock solution by adding 1 milliliter (mL) each of 10 mM of the seven aforementioned tracers (NS-based and PS-based tracers) into 93 mL deionized (DI) water to prepare 100 μM stock solutions of the seven tracers (collectively NS-based and PS-based tracers) in 100 mL DI water. Anthracene sulfonates (e.g., ANTS) can be tracers, and can be characterized as a NS-based tracer. Tracer solutions of 100 nM, 1 μM, and 10 μM were prepared by dilution from the stock solution.
2. Prepared buffer condition and ion-pair solution by adding 2.5 mL of 100 mM tetrabutylammonium bromide (TBAB) solution, 2.5 mL of 100 mM potassium dihydrogen phosphate solution and 2.5 milliliter (mL) of 65 mM disodium hydrogen phosphate solution into 50 mL pure water, resulting in a pH of 6.1.
3. The same amounts of buffer and ion-pair solutions were added to 100 mL of sample before the extraction of the analytes, which changed the initial concentration to 87 μM for the seven tracers.
4. After the SPE extraction using automated Gilson ASPEC®-271 system (available from Gilson incorporated having headquarters in Middleton, Wisconsin, USA), the sorbent was washed with 10 mL of conditioning solution. The Strata® X-RP is a SPE cartridge used for Gilson ASPEC-271 SPE system (instrument).
5. The analytes were eluted using 8 mL methanol, the solvent subsequently dried, and the solute was redissolved in 1 mL of deionized (DI) water.

Figure 6:
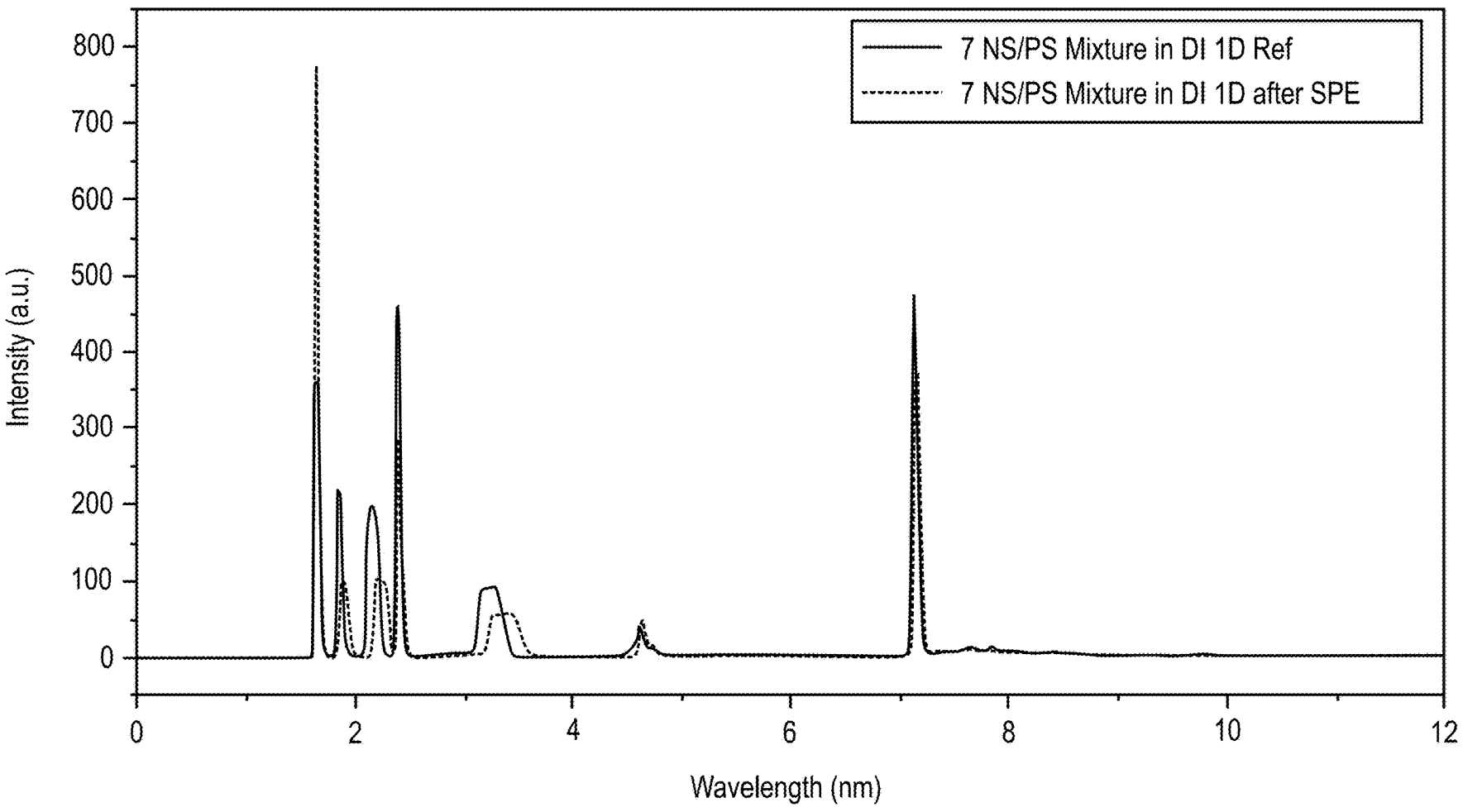
FIG. 6 is high-pressure liquid chromatography (HPLC) ultraviolet visible spectroscopy (UV-vis) chromatograms (plots of intensity versus wavelength) for solid-phase extraction (SPE) recovery factor estimation for tracers in deionized (DI) water.

FIG. 6 is HPLC UV-vis chromatograms for SPE recovery factor estimation for the seven tracers in DI water. The legend refers to NS and PS generally. The anthracene sulfonate derivative ANTS is included as NS.

FIG. 6 is a plot of intensity in arbitrary unit (a.u.) versus wavelength (nm). The legend refers to respective mixtures of the aforementioned seven tracers. A mixture of the 7 tracers was prepared and and analyzed by HPLC UV/vis. However, only 5 tracers were identified by HPLC. The other 2 tracers were not able to be separated or result in a strong enough signal. Two sets of such seven mixtures were prepared. The first set of the seven mixtures was the seven tracers prepared respectively in DI. The second set of seven mixtures was the seven tracers prepared respectively in DI after SPE, and only five tracers out of seven were separated and pre-concentrated by 1D HPLC.

The discussion now turns to the SPE recovery factor calculation for the seven tracers, which include NS-based tracers and PS-based tracers. The SPE experiments were performed for the seven tracers (1,5-NDS, 2,7-NDS, 2-NS, ANS, ANTS, Pyranine, and PTSA) in deionized water, and the SPE recovery factors were determined by comparing the concentrations of tracer molecules before and after the SPE treatment using ultraviolet (UV)-vis spectroscopic analysis. As shown in FIG. 6, most of the seven tracers were recovered up to 92%, which indicates that the developed SPE process with the Strata X-RP SPE cartridges is highly selective and effective, both in extraction efficiency and in cartridge capacity, for pre-concentrating 10 μM of NS-based tracers to improve their optical detection limit.

Figure 7:
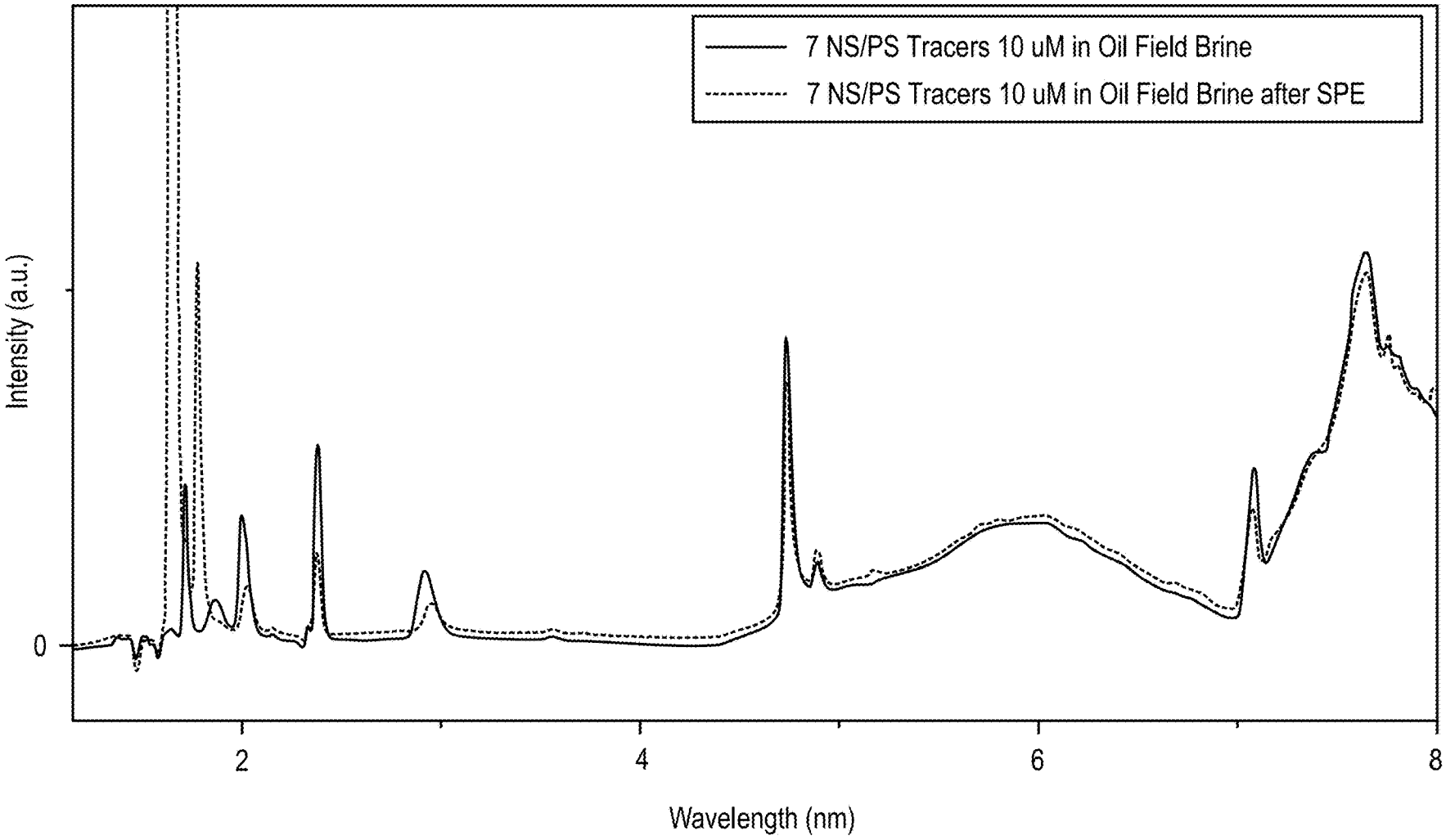
FIG. 7 is plots of HPLC UV-vis chromatograms for SPE recovery factor estimation for tracers in produced water.

FIG. 7 is HPLC UV-vis chromatograms for SPE recovery factor estimation for the seven tracers including five NS-based tracers (1,5-NDS, ANS, 2,7-NDS, 2-NS, and ANTS) and two PS-based tracers (pyranine and PTSA) in produced water (oilfield brine). The produced water (oilfield brine) was obtained from the Uthmaniyah field of eastern Saudi Arabia. SPE recovery factors for NS-based tracer mixtures in produced water (oilfield brine) were investigated by automated SPE process utilizing Gilson ASPEC-271 system using similar procedures. As shown in FIG. 7, the recovery factors range from 58% to 72%. Encouragingly, the recovery factors for NS-based tracers from produced water decreased only 10-20% in efficiency as compared to the recovery factors from DI water as shown in FIG. 6. It is anticipated that with these recovery factors, additional desalting may not be necessary. Embodiments of the present techniques can be further adjusted or optimized with focus on the operational conditions of the automated SPE system in terms of flow rates and condition/washing solution selection, etc.

Analysis of the seven tracers giving HPLC UV-vis chromatograms was performed to determine limits of detection (LODs) for the seven tracers. The chromatographs were collected for the seven tracers respectively in DI water (both no SPE and after SPE) at concentrations of 100 μM, 10 μm, 1 μm, 100 nm, and 10 nm. The seven tracers were clearly detected down to 100 nM.

HPLC UV-vis chromatograms were also collected to determine LODs for the seven tracers in oilfield brine both before and after SPE. The concentration of the respective tracer in the produced water was evaluated at 10 μm, 1 μm, and 100 nm. The UV-vis signals showed at least 1 uM for 2,7-NDS but the other tracer signals were obscured by in the background signal from the produced water. To improve (increase) detection as applicable, the 2D-LC separation method with fluorescence detection is utilized.

2D-HPLC separation of the aforementioned seven tracers was performed. To improve (increase) sensitivity and separate analytes further from the produced water matrix background, two-dimensional HPLC separation was carried out using 2D-LC technology (instrument) from Agilent Technology, Inc. having headquarters in Santa Clara, California, USA. At the elution time of each peak in the first separation, the effluent flow was diverted into a heart-cutting loop and reinjected into a second column under different LC conditions. The effluent from the second separation was then analyzed using a fluorescence detector.

All HPLC was performed using an Agilent 1290 Infinity II HPLC system with 2D add-on components. The 1D separation conditions included an Agilent Zorbax SB-Aq column, 4.6×150 mm, with 3 μm particle size. The mobile phase consisted of (A) water with 0.3 volume % [vol %] phosphoric acid, and (B) acetonitrile. The flow rate was 1.0 mL/minute (mL/min). The $1^{st}$ dimension gradient started at 3 vol % (B) for the first 2 min, then increased to 50 vol % (B) at 8 min. The column was then flushed with 100% (B) for 2 min, and returned to 3 vol % (B) to re-equilibrate for the remaining duration of the 2D separation. Due to the time required to complete the $2^{nd}$ dimension separation, the $1^{st}$ dimension flow rate was reduced to 0.1 mL/min after 12 min to conserve solvent.

The second separation employed a Phenomenex Kinetex-F5 column, 2.1×150 mm with 2.6 μm particle size. The mobile phase consisted of (A) water with 0.3 vol % phosphoric acid and (B) acetonitrile. The flow rate was 1.0 mL/min. The $2^{nd}$ dimension gradient started at 10% (B) for 0.5 min, then increased to 60 vol % (B) at 3 min. The column was re-equilibrated at 10 vol % (B) for 0.5 min prior to the subsequent analysis.

The first-dimension setup included a UV diode array detector (DAD) to monitor the peaks eluting from the first column. The second-dimension setup included a fluorescence detector (FLD) to quantify the fully separated peaks as they eluted from the second column. For maximum sensitivity, the fluorescence excitation and emission wavelengths were programmatically adjusted between 2D runs to match the literature values for maximum fluorescence intensity of each respective tracer. The fluorescence chromatograms for each 2D separation were collected. The seven tracer solutions in produced water with various concentrations (100 mM, 1 μM and 10 μM) were processed SPE and pre-concentrated 100 times. The solutions were separated by 1D HPLC and UV-vis chromatogram showed most of peaks were again buried by signals from produced water. Based on the elution times of each tracer measured using DI water, 2D-LC separation has been performed and fluorescence detector (FLD) chromatograms showed clear separation at least 4 out of the 7 tracers. The LODs were determined with signal-to-noise ratio (S/N)=3 as down to 100 nM for pyranine, 1 μM for 2,7-NDS, 1 μM for ANS, and 100 nM for 1,5-NDS. It was difficult to separate PTSA, ANTS and 2-NS using 2D HPLC from the mixture of seven tracers in oil field brine (e.g., FIG. 9).

Further improvement of NS-based tracer separation using ion-pair chromatography was performed. Due to the high water-solubility of the aforementioned seven tracers (1,5-NDS, 2,7-NDS, 2-NS, ANS, ANTS, Pyranine, and PTSA), typical reversed-phase chromatography using nonpolar stationary phase results in very short retention of the analytes, even at highly aqueous mobile phase conditions. Although baseline separation is achieved in clean samples, the majority of the analytes are eluted within the first 1-2 column volumes after injection. This presents a challenge for separating the seven tracers from ground water samples, due to the relatively large amount of water-soluble interferents in the water which also elute early in the HPLC separation and could obfuscate the tracer peaks. 2D-LC helps alleviate this issue by further separating the co-eluted compounds, but sensitivity could be improved (increased) by increasing the retention of the NS-based tracer candidates in the first dimension.

To do this, ion-pairing chromatography was employed. An ion-pairing agent, tetramethylammonium hydroxide (TMAOH), was added to both aqueous component of the mobile phase at 50 mM, and the pH was adjusted to 6.4 with phosphoric acid. The ion-pairing agent is a molecule with both nonpolar and polar regions. The presence of the ion-pairing agent increases retention of polar analytes by interacting with both the nonpolar stationary phase and the polar analytes in solution.

The ion pairing technique method. Ion pairing HPLC separation of a mixture of the seven tracers was carried out using an Agilent Infinity II 1290 system fitted with a 2.1×150 mm, pentafluorophenyl (PFP) column with 3.0 μM particle size. The mobile phase consisted of (A) 50 mM TMAOH in HPLC water adjusted to pH 6.4 with HPLC grade phosphoric acid, and (B) acetonitrile. The flow rate was 0.5 mL/min. Due to the ion pairing conditions, a long equilibration time (10 min) was required prior to sample injection to allow the column and ion pairing agents to equilibrate. The run started under isocratic conditions at 5 vol % (B) for the first 3 minutes, then a linear gradient was followed up to 40 vol % (B) at 18 minutes. 40 vol % (B) was maintained until 24 minutes, and then returned to 5 vol % B for 10 minutes to re-equilibrate the column for subsequent separations. Due to poor solubility of tetramethylammonium hydroxide (TMAOH) salt in acetonitrile, care was taken not to exceed 40 vol % acetonitrile to avoid precipitation.

Figure 8:
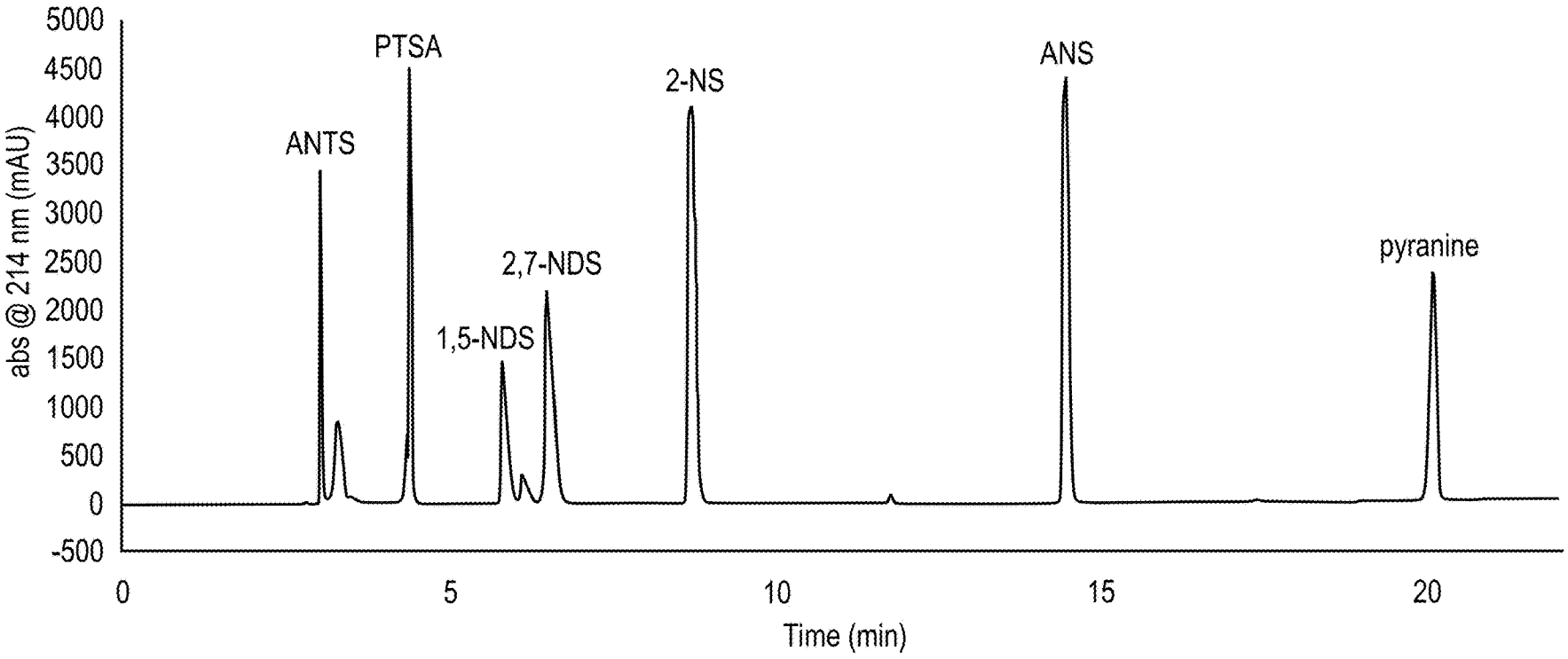
FIG. 8 is plot (chromatogram) of abs [UV absorbance] over time depicting the successful baseline separation of tracers in first dimension.
Figure 9:
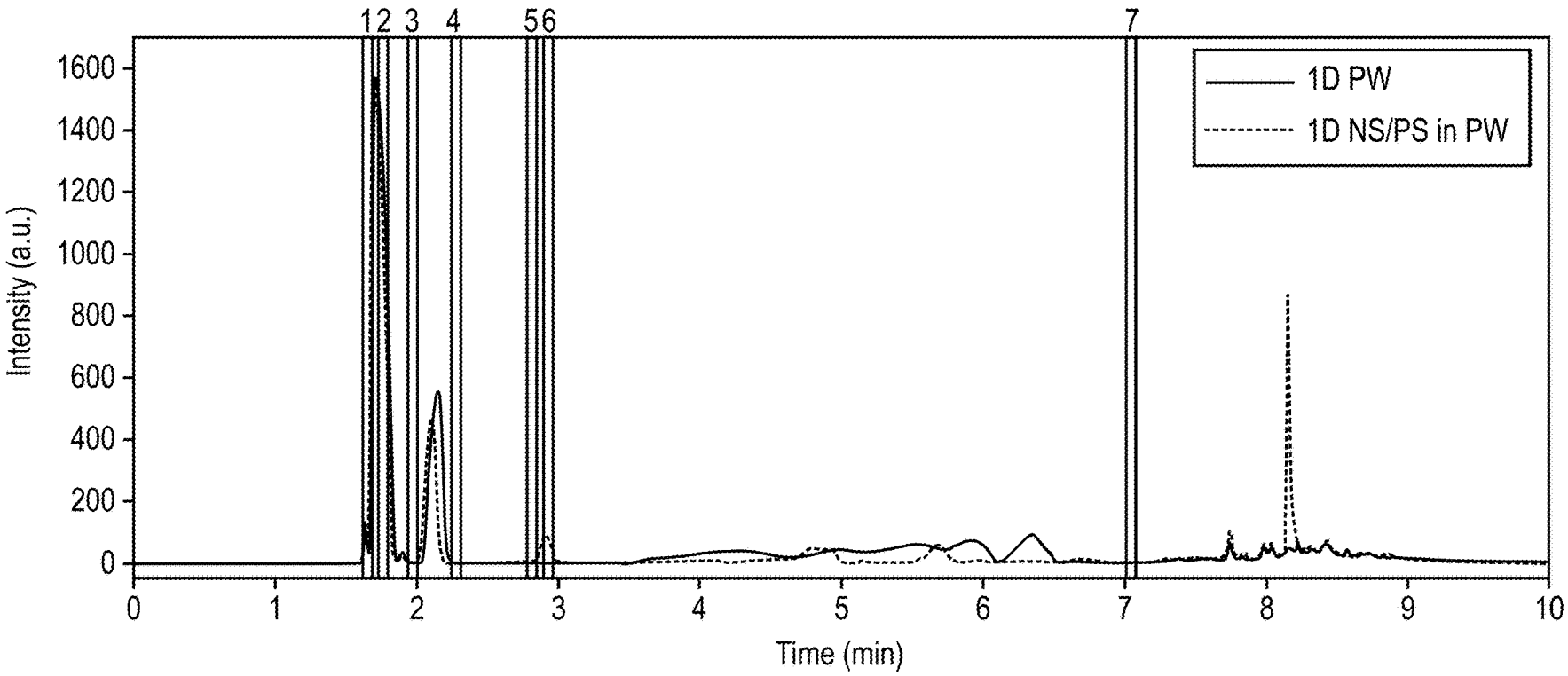
FIG. 9 is a plot of HPLC UV-vis chromatograms for limit of detection of tracers in oil field brine (produced water) with one-dimensional (1D) HPLC.
Figure 10:
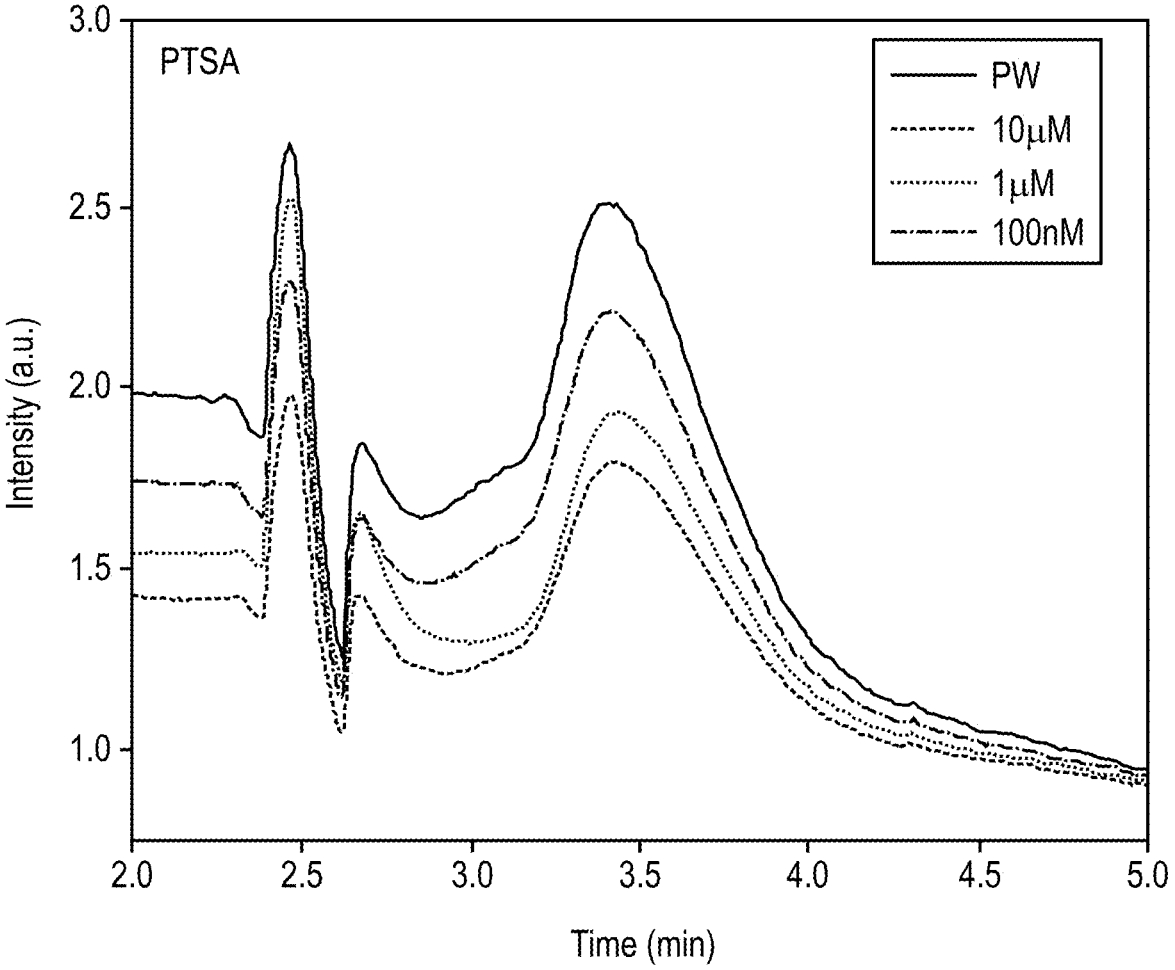
FIG. 10-16 are plots of HPLC UV-vis chromatograms for limit of detection of tracers in oil field brine (produced water) with two-dimensional (2D) HPLC.
Figure 11:
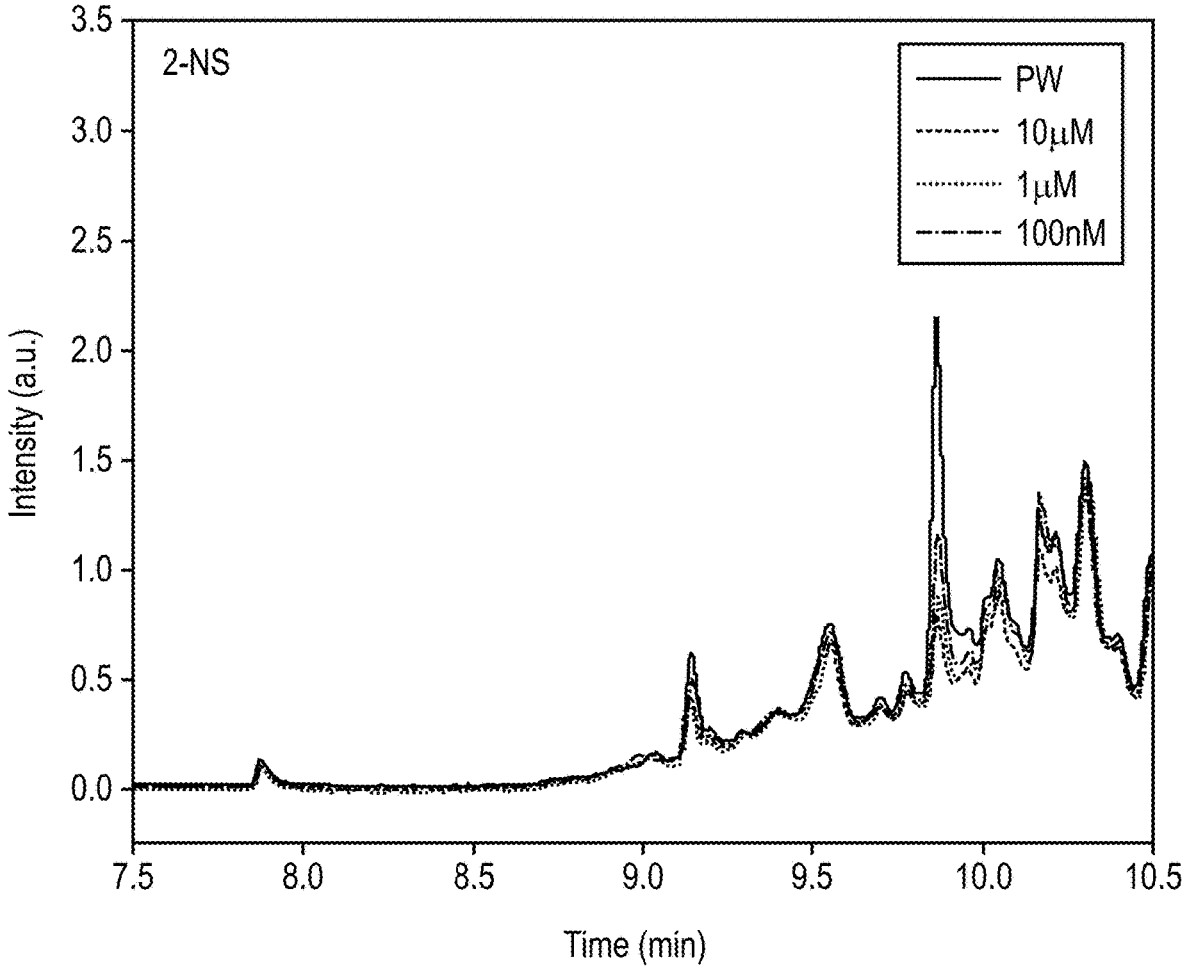
Figure 12:
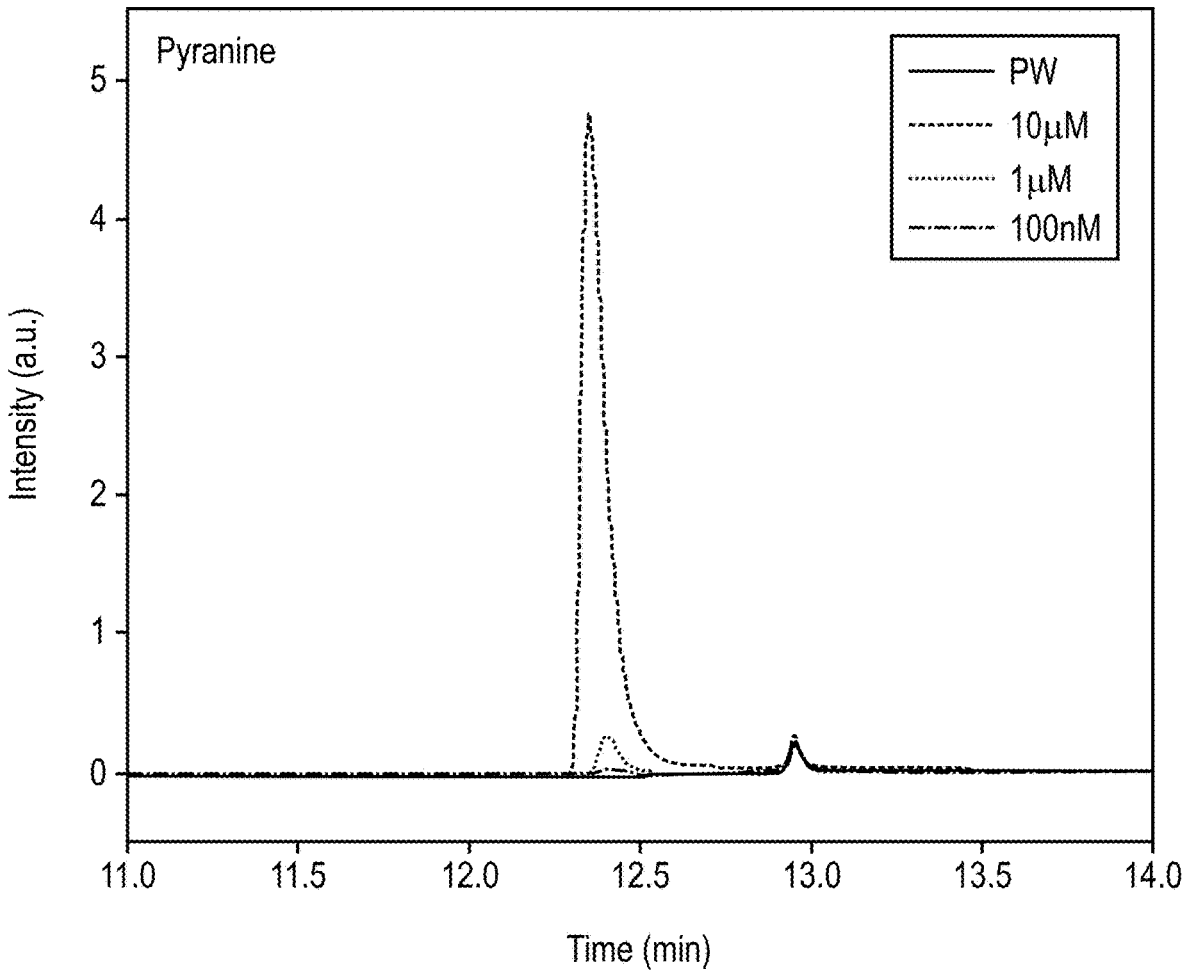
Figure 13:
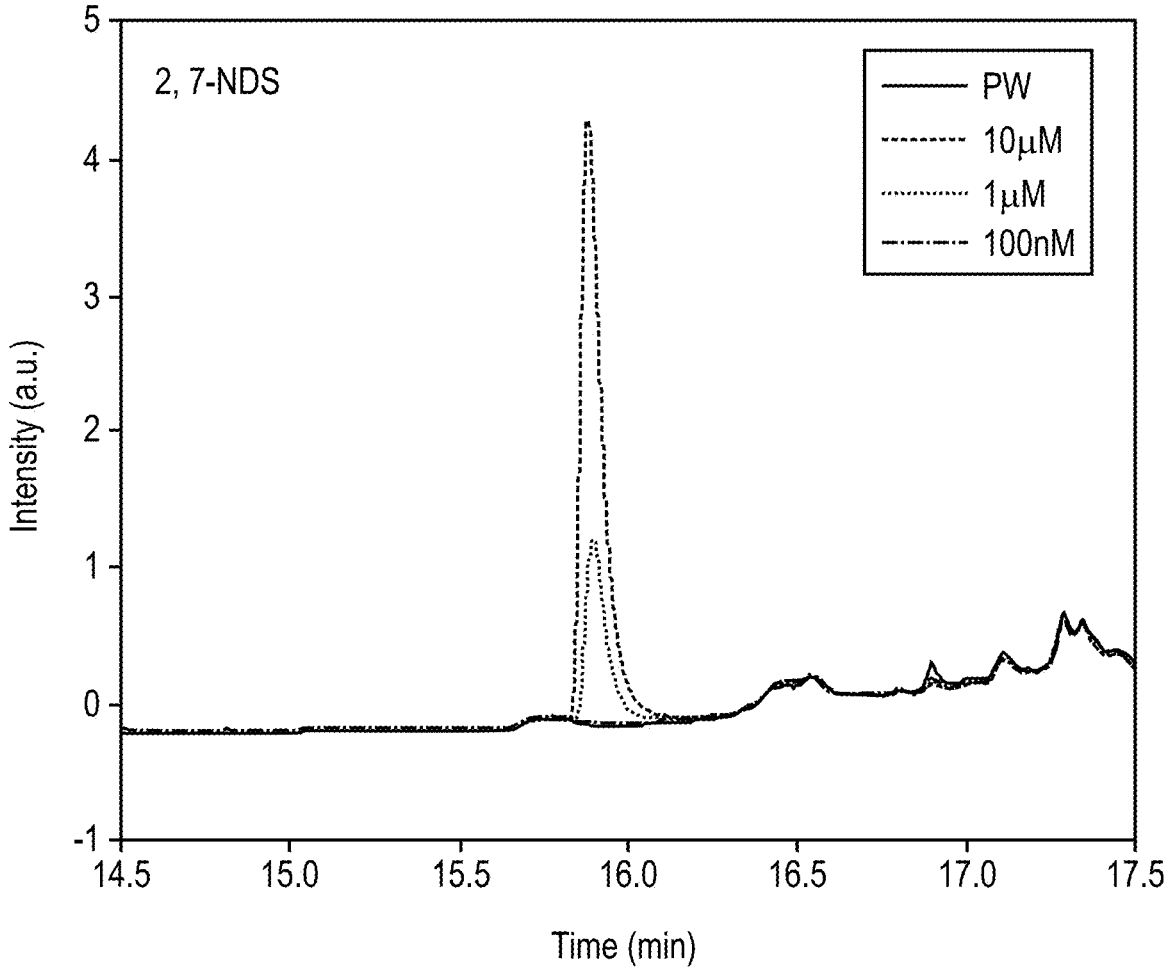
Figure 14:
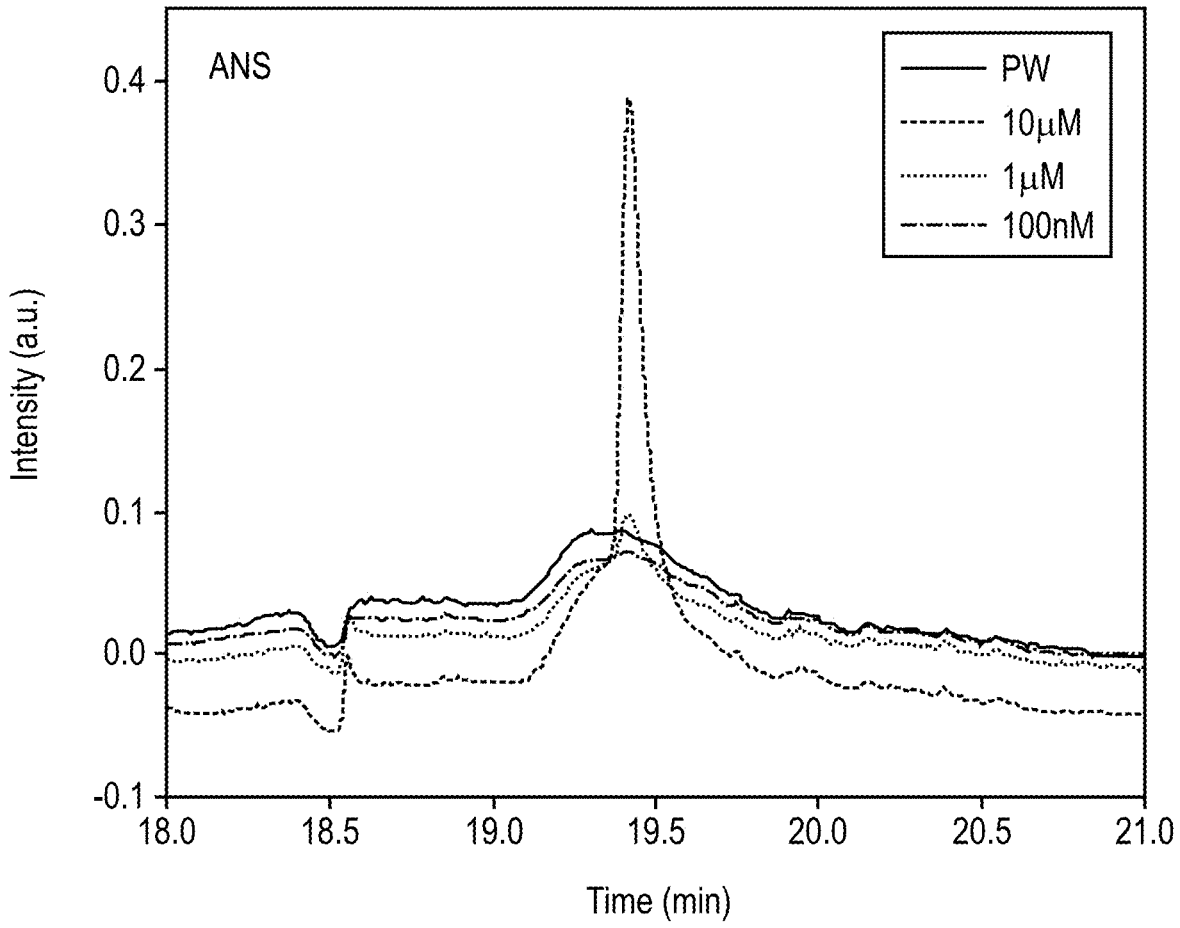
Figure 15:
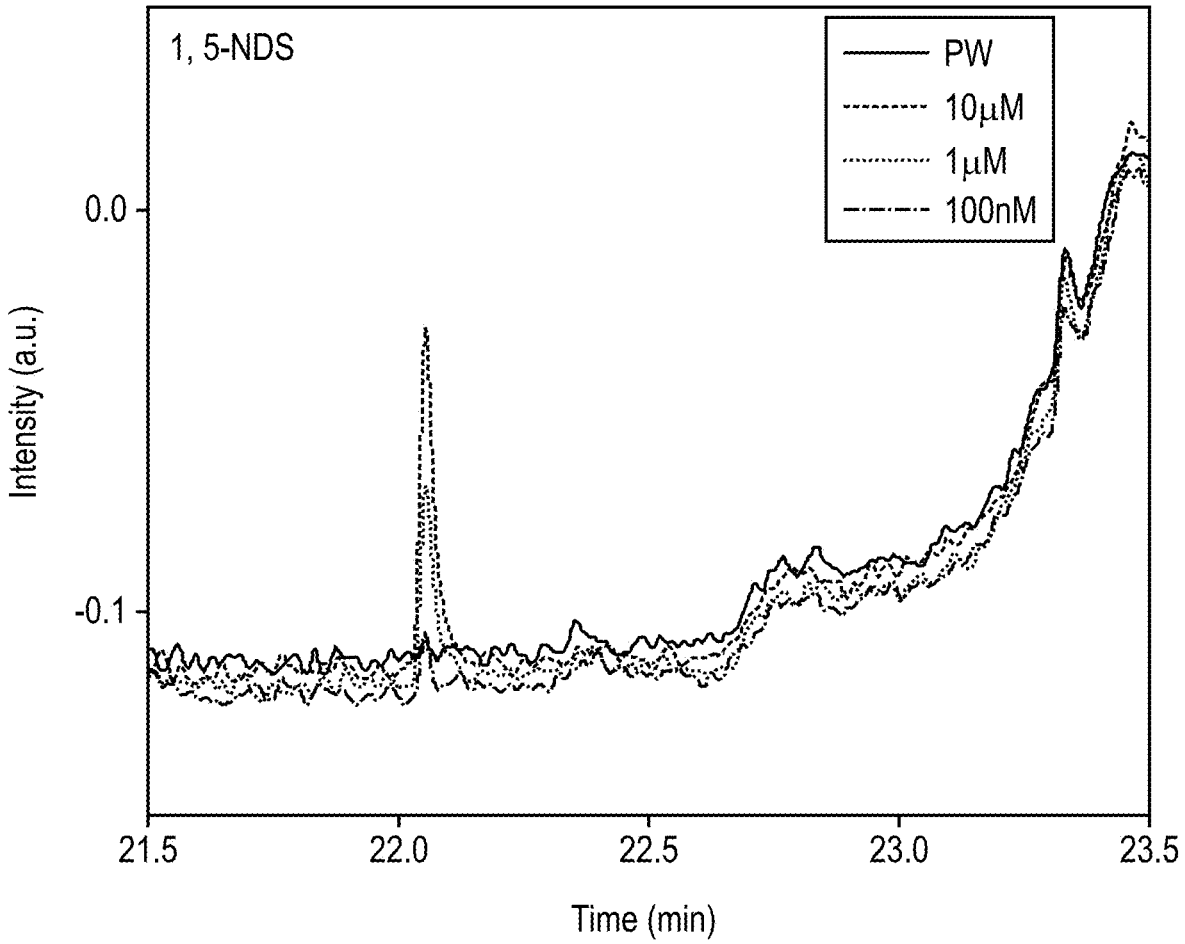
Figure 16:
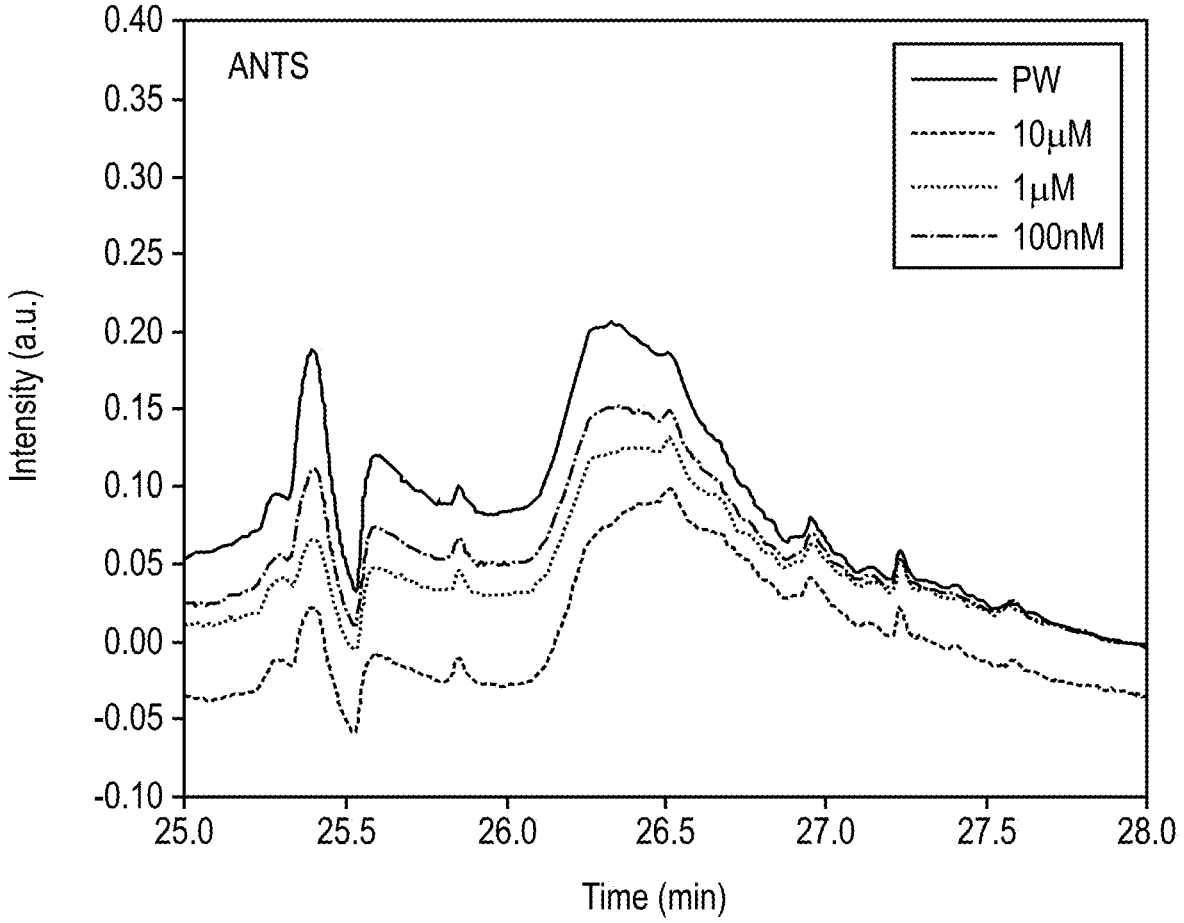

FIG. 8 depicts the successful baseline separation of the aforementioned seven tracers in first dimension with retention time (RT)>2 min FIG. 8 is plot (chromatogram) of abs [absorbance] over time. Preliminary data to assess the quality of the separation was captured using a UV-vis absorbance diode-array detector (DAD) configured to collect two chromatograms at 214 and 254 nm, respectively. FIG. 8 shows a chromatogram of the seven tracers separated by ion-pair chromatography. All analytes are eluted at least 1 column volume after the injection. FIGS. 9-16 show chromatogram of the seven tracers in oil field brine (produced water) including separated and detected by 2D LC. Detected were 100 nM (=about 30 ppb) for pyranine, 1 μM for 2,7-NDS, 1 μM for ANS, and 100 nM for 1,5-NDS. FIG. 9 is a plot of HPLC UV-vis chromatograms for limit of detection of tracers in oil field brine (produced water [PW]) with one-dimensional (1D) HPLC. FIG. 10-16 are plots of HPLC UV-vis chromatograms for limit of detection of tracers in oil field brine (produced water [PW]) with two-dimensional (2D) HPLC. The seven tracers are PTSA, 2-NS, pyranine, 2,7-NDS, ANS, 1,5-NDS, and ANTS.

In summary, disclosed herein are selectively soluble taggants (e.g., the aforementioned seven tracers) to be injected from the surface via capillary dosing lines into different sections or zones of a multilateral well. These taggants are designed to mark different fluid phases produced from each zone and be carried by the produced oil and water to the surface. Their concentrations measured at the surface—specifically, how their concentrations decrease over time after dosing is shut off—allows for the computation of the oil producing rates from each zone.

Materials suitable as the aqueous phase taggants include derivatives of sulfonated naphthalene, anthracene and pyrene, which are known to have high solubility in water and are stable at high temperatures in excess of 150° C. These materials can be concentrated by solid phase extraction (SPE) and detected by UV-vis and fluorometry after reversed phase HPLC separation. Similarly, water-soluble derivatives of dipicolinic acid and phenanthroline dicarboxylic acid are suitable aqueous phase taggant that can be preconcentrated and detected fluorometrically in an HPLC setup after addition of lanthanide ions post chromatographic separation.

As mentioned, a carrier fluid may promote or advance injection of the taggant via a capillary dosing tube from the surface into the different zones in the reservoir. For water-soluble taggants, the carrier fluid may be injection water (e.g., seawater, tap water, deionized water etc.) or a polar solvent with relatively high boiling point and low volatility, such as ethylene glycol.

Automatable chromatographic methods with inline optical detection, such as the described SPE-HPLC inline detection methods for analyzing crosswell tracers, can be utilized as well. Aqueous phase taggants that are molecular-based in produced water can be processed through techniques of SPE-reversed phase HPLC inline detection.

An embodiment is a method of quantifying zonal flow in a multi-lateral well, including providing a first taggant through a first dosing tubing to a first lateral in a wellbore of the multi-lateral well; providing a second taggant through a second dosing tubing to a second lateral in the wellbore; flowing a first produced fluid including hydrocarbon (e.g., including crude oil or natural gas, or both) and water from a subterranean formation via the first lateral through a first valve into production tubing in the wellbore; flowing a second produced fluid including hydrocarbon and water from the subterranean formation via the second lateral through a second valve into the production tubing; flowing a produced stream including the first produced fluid and the second produced fluid uphole through the production tubing and discharging the produced stream from the wellbore; and analyzing the produced stream to measure an amount of the first taggant in the produced stream and an amount of the second taggant in the produced stream, wherein the first taggant and the second taggant are water soluble. The wellbore may be formed through Earth surface into the subterranean formation in Earth crust. The first taggant and the second taggant each may each be or include at least one of a naphthalene sulfonate, a pyrene sulfonate derivative, or an anthracene sulfonate. The first taggant and the second taggant may each be or include at least one of Disodium 1,5-naphthalenedisulfonate hydrate (1,5-NDS), Disodium 2,7-naphthalenedisulfonate (2,7-NDS), Sodium 2-naphthalenesulfonate (2-NS), Sodium 4-amino-1-naphthalenesulfonate tetrahydrate (ANS), 8-Aminonaphthalene-1,3,6-trisulfonic acid, disodium salt (ANTS), Pyranine, or 1,3,6,8-Pyrenetetrasulfonic acid (PTSA). The first taggant is generally different from the second taggant. The first valve and the second valve may be disposed along the production tubing to receive the first produced fluid and the second produced fluid, respectively, into the production tubing. The first valve and the second valve may each be an interval control valve (ICV). The method may include determining an amount of the first produced fluid in the produced stream and an amount of second produced fluid in the produced stream based on the amount of the first taggant in the produced stream as measured and the amount of the second taggant in the produced stream as measured. In particular, the ratio of decay rates of the taggants following the transient indicates the ratio of flow rates of each produced fluid.

Another embodiment is a method of quantifying zonal flow in a multi-lateral well, including providing a first tracer through a first dosing tubing to a first region of a wellbore of the multi-lateral well, the first region associated with a first lateral of the wellbore; providing a second tracer through a second dosing tubing to a second region of the wellbore, the second region associated with a second lateral of the wellbore, wherein the first tracer comprises a first sulfonate and the second tracer comprises a second sulfonate; flowing from a subterranean formation a first produced fluid including hydrocarbon (e.g., crude oil or natural gas, or both) and water through the first lateral and a first valve into production tubing in the wellbore; flowing from the subterranean formation a second produced fluid comprising hydrocarbon and water through the second lateral and a second valve into the production tubing; flowing a produced stream comprising the first produced fluid and the second produced fluid uphole through the production tubing and discharging the produced stream from the wellbore; and analyzing the produced stream to measure an amount of the first tracer in the produced stream and an amount of the second tracer in the produced stream. The first region may include an intersection of the first lateral with a vertical portion of the wellbore, and the second region may include an intersection of the second lateral with the vertical portion, wherein the production tubing is disposed in the vertical portion. The first tracer and the second tracer are water-soluble. The first sulfonate and the second sulfonate may each include at least one of a naphthalene sulfonate, a pyrene sulfonate, or an anthracene sulfonate. The first sulfonate and the second sulfonate may each include at least one of 1,5-NDS, 2,7-NDS, 2-NS, ANS, ANTS, Pyranine, or PTSA. The first tracer may be different from the second tracer. The method may include determining an amount of the first produced fluid in the produced stream and an amount of second produced fluid in the produced stream based on the amount of the first tracer in the produced stream as measured and the amount of the second tracer in the produced stream as measured. The method may include determining a volume ratio of the first produced fluid in the produced stream to the second produced fluid in the produced stream based on the amount of the first tracer in the produced stream as measured and the amount of the second tracer in the produced stream as measured. The first valve and the second valve may be disposed along the production tubing. The first valve and the second valve may each be an ICV. The wellbore may formed through Earth surface into the subterranean formation in Earth crust. The first tracer may be provided from the Earth surface through the first dosing tubing to the first region, and the second tracer may be provided from the Earth surface through the second dosing tubing to the second region.

Yet another embodiment is a method of quantifying zonal flow in a multi-lateral well, including: providing a first taggant from Earth surface through a first dosing tubing to a first region in a wellbore of the multi-lateral well, wherein the wellbore is formed through the Earth surface into a subterranean formation in Earth crust, wherein the first region is a region of intersection of a first lateral in the wellbore with a vertical portion of the wellbore; providing a second taggant from the Earth surface through a second dosing tubing to a second region in the wellbore, wherein the second region is a region of intersection of a second lateral in the wellbore with the vertical portion; producing a first produced fluid from the subterranean formation through the first lateral into production tubing in the wellbore; producing a second produced fluid from the subterranean formation through the second lateral into the production tubing; flowing a produced stream comprising the first produced fluid and the second produced fluid uphole through the production tubing and discharging the produced stream from the wellbore; and analyzing the produced stream to measure an amount of the first taggant in the produced stream and an amount of the second taggant in the produced stream, wherein the first taggant and the second taggant each comprise at least one of Disodium 1,5-naphthalenedisulfonate hydrate (1,5-NDS), Disodium 2,7-naphthalenedisulfonate (2,7-NDS), Sodium 2-naphthalenesulfonate (2-NS), Sodium 4-amino-1-naphthalenesulfonate tetrahydrate (ANS), 8-Aminonaphthalene-1,3,6-trisulfonic acid, disodium salt (ANTS), Pyranine, or 1,3,6,8-Pyrenetetrasulfonic acid (PTSA). The first taggant may be different from the second taggant. Producing the first produced fluid may involve flowing the first produced fluid through a first valve into the production tubing, and producing the second produced fluid may involve flowing the second produced fluid through a second valve into the production tubing. The first valve (e.g., ICV) and second valve (e.g., ICV) may be disposed along the production tubing. The production tubing may be disposed in the vertical portion of the wellbore. The first produced fluid and the second produced fluid may each include hydrocarbon and water. The hydrocarbon may include, for example, crude oil or natural gas, or both. The method may include calculating an amount of the first produced fluid in the produced stream and an amount of second produced fluid in the produced stream based on the amount of the first taggant in the produced stream as measured and the amount of the second taggant in the produced stream as measured.

A number of implementations have been described. Nevertheless, it will be understood that various modifications may be made without departing from the spirit and scope of the disclosure.

What is claimed is:

1. A method of quantifying zonal flow in a multi-lateral well, comprising:

running a first dosing tubing from Earth's surface to an intersection of a first lateral and a vertical portion of a wellbore of the multi-lateral well;

providing a first taggant through the first dosing tubing at the intersection of the first lateral and the vertical portion of the wellbore;

running a second dosing tubing from the Earth's surface to an intersection of a second lateral and the vertical portion of the wellbore;

providing a second taggant through the second dosing tubing at the intersection of the second lateral and the vertical portion of the wellbore;

flowing a first produced fluid comprising hydrocarbon and water from a subterranean formation via the first lateral through a first valve into production tubing in the wellbore, wherein the first valve is at the intersection of the first lateral and the vertical portion of the wellbore, and wherein the first taggant is provided adjacent to the first valve;

flowing a second produced fluid comprising hydrocarbon and water from the subterranean formation via the second lateral through a second valve into the production tubing, wherein the second valve is at the intersection of the second lateral and the vertical portion of the wellbore, and wherein the second taggant is provided adjacent to the second valve;

flowing a produced stream comprising the first produced fluid and the second produced fluid uphole through the production tubing and discharging the produced stream from the wellbore; and analyzing the produced stream to measure an amount of the first taggant in the produced stream and an amount of the second taggant in the produced stream, wherein the first taggant and the second taggant are water soluble.

2. The method of claim 1, wherein the first taggant and the second taggant each comprise at least one of a naphthalene sulfonate, a pyrene sulfonate derivative, or an anthracene sulfonate.

3. The method of claim 1, wherein the first taggant and the second taggant each comprise at least one of Disodium 1,5-naphthalenedisulfonate hydrate (1,5-NDS), Disodium 2,7-naphthalenedisulfonate (2,7-NDS), Sodium 2-naphthalenesulfonate (2-NS), Sodium 4-amino-1-naphthalenesulfonate tetrahydrate (ANS), 8-Aminonaphthalene-1,3,6-trisulfonic acid, disodium salt (ANTS), Pyranine, or 1,3,6, 8-Pyrenetetrasulfonic acid (PTSA).

4. The method of claim 1, wherein the hydrocarbon comprises crude oil or natural gas, or both, wherein the first taggant is different from the second taggant, and wherein the first valve and the second valve are disposed along the production tubing to receive the first produced fluid and the second produced fluid, respectively, into the production tubing.

5. The method of claim 4, wherein the first valve and the second valve are each an interval control valve (ICV), and wherein the wellbore is formed through the Earth's surface into the subterranean formation in Earth's crust.

6. The method of claim 1, comprising determining an amount of the first produced fluid in the produced stream and an amount of second produced fluid in the produced stream based on the amount of the first taggant in the produced stream as measured and the amount of the second taggant in the produced stream as measured.

7. A method of quantifying zonal flow in a multi-lateral well, comprising:

running a first dosing tubing from Earth's surface to a first intersection of a first lateral of a wellbore with a vertical portion of the wellbore;

providing a first tracer at the first intersection of the first lateral of the wellbore with the vertical portion of the wellbore;

running a second dosing tubing from the Earth's surface of the wellbore to a second intersection of a second lateral of the wellbore with the vertical portion of the wellbore;

providing a second tracer at the second intersection of the second lateral of the wellbore with the vertical portion of the wellbore, wherein the first tracer comprises a first sulfonate and the second tracer comprises a second sulfonate;

flowing from a subterranean formation a first produced fluid comprising hydrocarbon and water through the first lateral and a first valve into production tubing in the wellbore, wherein the first valve is at the intersection of the first lateral and the vertical portion of the wellbore, and wherein the first tracer is provided adjacent to the first valve;

flowing from the subterranean formation a second produced fluid comprising hydrocarbon and water through the second lateral and a second valve into the production tubing, wherein the second valve is at the intersection of the second lateral and the vertical portion of the wellbore, and wherein the second tracer is provided adjacent to the second valve;

flowing a produced stream comprising the first produced fluid and the second produced fluid uphole through the production tubing and discharging the produced stream from the wellbore; and analyzing the produced stream to measure an amount of the first tracer in the produced stream and an amount of the second tracer in the produced stream.

8. The method of claim 7, wherein the production tubing is disposed in the vertical portion.

9. The method of claim 7, wherein the first tracer and the second tracer are water soluble, and wherein the first sulfonate and the second sulfonate each comprise at least one of a naphthalene sulfonate, a pyrene sulfonate, or an anthracene sulfonate.

10. The method of claim 7, wherein the first sulfonate and the second sulfonate each comprise at least one of Disodium 1,5-naphthalenedisulfonate hydrate (1,5-NDS), Disodium 2,7-naphthalenedisulfonate (2,7-NDS), Sodium 2-naphthalenesulfonate (2-NS), Sodium 4-amino-1-naphthalenesulfonate tetrahydrate (ANS), 8-Aminonaphthalene-1,3,6-trisulfonic acid, disodium salt (ANTS), Pyranine, or 1,3,6, 8-Pyrenetetrasulfonic acid (PTSA).

11. The method of claim 7, comprising determining an amount of the first produced fluid in the produced stream and an amount of second produced fluid in the produced stream based on the amount of the first tracer in the produced stream as measured and the amount of the second tracer in the produced stream as measured.

12. The method of claim 7, wherein the hydrocarbon comprises crude oil or natural gas, or both, wherein the first tracer is different from the second tracer, and wherein the first valve and the second valve are disposed along the production tubing.

13. The method of claim 12, wherein the first valve and the second valve are each an interval control valve (ICV), and wherein the wellbore is formed through the Earth's surface into the subterranean formation in the Earth's crust.

14. The method of claim 13, wherein the first tracer is provided from the Earth's surface through the first dosing tubing to the first intersection, and wherein the second tracer is provided from the Earth's surface through the second dosing tubing to the second intersection.

15. A method of quantifying zonal flow in a multi-lateral well, comprising:

running, from Earth's surface, a first dosing tubing to a first region in a wellbore of the multi-lateral well, wherein the wellbore is formed through the Earth's surface into a subterranean formation in Earth's crust, wherein, at the first region, a first lateral in the wellbore intersects with a vertical portion of the wellbore;

providing a first taggant through the first dosing tubing to the first region at which the first lateral intersects with the vertical portion of the wellbore;

running, from the Earth's surface, a second dosing tubing to a second region in the wellbore, wherein, at the second region, a second lateral in the wellbore intersects with the vertical portion;

providing a second taggant through the second dosing tubing to the second region at which the second lateral intersects with the vertical portion of the wellbore;

producing a first produced fluid from the subterranean formation through the first lateral into production tubing in the wellbore, wherein the first produced fluid is flowed into the production tubing via a first valve positioned at the intersection of the first lateral and the vertical portion of the wellbore, wherein the first taggant is provided adjacent to the first valve;

producing a second produced fluid from the subterranean formation through the second lateral into the production tubing, wherein the second produced fluid is flowed into the production tubing via a second valve positioned at the intersection of the second lateral and the vertical portion of the wellbore, wherein the second taggant is provided adjacent to the second valve;

flowing a produced stream comprising the first produced fluid and the second produced fluid uphole through the production tubing and discharging the produced stream from the wellbore; and analyzing the produced stream to measure an amount of the first taggant in the produced stream and an amount of the second taggant in the produced stream, wherein the first taggant and the second taggant each comprise at least one of Disodium 1,5-naphthalenedisulfonate hydrate (1,5-NDS), Disodium 2,7-naphthalenedisulfonate (2,7-NDS), Sodium 2-naphthalenesulfonate (2-NS), Sodium 4-amino-1-naphthalenesulfonate tetrahydrate (ANS), 8-Aminonaphthalene-1,3,6-trisulfonic acid, disodium salt (ANTS), Pyranine, or 1,3,6,8-Pyrenetetrasulfonic acid (PTSA).

16. The method of claim 15, wherein the first valve and second valve are disposed along the production tubing.

17. The method of claim 16, wherein the first valve and the second valve are each an interval control valve (ICV).

18. The method of claim 15, wherein the first produced fluid comprises hydrocarbon and water, wherein the hydrocarbon comprises crude oil or natural gas, or both, and wherein the first taggant is different from the second taggant.

19. The method of claim 15, wherein the second produced fluid comprises hydrocarbon and water, wherein the hydrocarbon comprises crude oil or natural gas, or both, and wherein the production tubing is disposed in the vertical portion of the wellbore.

20. The method of claim 15, comprising calculating an amount of the first produced fluid in the produced stream and an amount of second produced fluid in the produced stream based on the amount of the first taggant in the produced stream as measured and the amount of the second taggant in the produced stream as measured.

* * * * *